US008684504B2

(12) United States Patent
Hill

(10) Patent No.: US 8,684,504 B2
(45) **Date of Patent: *Apr. 1, 2014**

(54) INK JET PRINTING

(71) Applicant: Linx Printing Technologies Ltd., Cambridgeshire (GB)

(72) Inventor: Anthony Hill, Cambridgeshire (GB)

(73) Assignee: Linx Printing Technologies Ltd., Cambridgeshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/754,225

(22) Filed: Jan. 30, 2013

(65) Prior Publication Data

US 2013/0141492 A1 Jun. 6, 2013

Related U.S. Application Data

(62) Division of application No. 12/532,094, filed as application No. PCT/GB2008/000836 on Mar. 12, 2008, now Pat. No. 8,388,118.

(30) Foreign Application Priority Data

Mar. 27, 2007 (GB) ..... 0705902.5

(51) Int. Cl.
*B41J 2/02* (2006.01)
*B41J 2/18* (2006.01)

(52) U.S. Cl.
USPC ..... 347/73; 347/89

(58) Field of Classification Search
USPC ..... 347/73–83, 89
See application file for complete search history.

(56) References Cited

U.S. PATENT DOCUMENTS

| | | | |
|---|---|---|---|
| 3,055,856 | A | 9/1962 | Sutherland, Jr. |
| 4,023,182 | A | 5/1977 | Arway et al. |
| 4,121,222 | A | 10/1978 | Diebold et al. |
| 4,270,133 | A | 5/1981 | Shimazawa et al. |
| 4,283,730 | A | 8/1981 | Graf |
| 4,286,274 | A | 8/1981 | Shell et al. |

(Continued)

FOREIGN PATENT DOCUMENTS

| | | |
|---|---|---|
| EP | 0 228 828 | 7/1987 |
| EP | 0560332 | 9/1993 |

(Continued)

OTHER PUBLICATIONS

USPTO Office Action dated Mar. 4, 2011 in U.S. Appl. No. 12/576,907.

(Continued)

*Primary Examiner* — Julian Huffman
(74) *Attorney, Agent, or Firm* — Cozen O'Connor

(57) ABSTRACT

A continuous ink jet printer has a line (69*a*) for venting at least some of the air that has been sucked along the gutter line (17), and a line (69*b*) for recirculating back to the printhead (25) at least some of the air that has been sucked down the gutter line (17). Preferably the relative proportions of vented air and recirculated air can be varied, so as to reduce solvent loss during normal operation but allow increased solvent loss if the ink is over-dilute. Preferably the air recirculated to the printhead is connected directly into the flow path from the gutter orifice to the source of gutter suction, without opening into the space containing the ink jet. This reduces the tendency of solvent in the recirculated air condense on the printhead electrodes.

7 Claims, 11 Drawing Sheets

(56) References Cited

U.S. PATENT DOCUMENTS

| | | | |
|---|---|---|---|
| 4,337,468 | A | 6/1982 | Mizuno |
| 4,360,817 | A | 11/1982 | Arway et al. |
| 4,403,227 | A | 9/1983 | Bertschy et al. |
| 4,413,267 | A | 11/1983 | Hein |
| 4,527,170 | A | 7/1985 | Iwasaki et al. |
| 4,575,735 | A | 3/1986 | Weinberg |
| 4,602,662 | A | 7/1986 | Eremity et al. |
| 4,658,268 | A | 4/1987 | Needham |
| 4,714,931 | A | 12/1987 | Erskine et al. |
| 4,825,228 | A | 4/1989 | Gloeeckler et al. |
| 4,890,119 | A | 12/1989 | Eremity et al. |
| 4,940,996 | A | 7/1990 | Paton |
| 4,942,409 | A | 7/1990 | Paton et al. |
| 4,998,116 | A | 3/1991 | Regnault |
| 5,155,528 | A | 10/1992 | Morishige et al. |
| 5,202,702 | A | 4/1993 | Terasawa et al. |
| 5,252,993 | A | 10/1993 | Tomii et al. |
| 5,331,339 | A | 7/1994 | Takahashi |
| 5,418,557 | A | 5/1995 | Pullen |
| 5,451,987 | A | 9/1995 | Perrin |
| 5,532,720 | A | 7/1996 | Krueger et al. |
| 5,623,292 | A | 4/1997 | Shrivastava et al. |
| 5,659,935 | A | 8/1997 | Lo-Pinto et al. |
| 5,701,149 | A | 12/1997 | Pagnon et al. |
| 5,758,580 | A | 6/1998 | Murray |
| 5,805,181 | A | 9/1998 | Tanaka et al. |
| 5,831,645 | A | 11/1998 | Shimoda |
| 5,920,332 | A | 7/1999 | Brooks |
| 6,234,620 | B1 | 5/2001 | Faisst, Jr. et al. |
| 6,398,351 | B1 | 6/2002 | Blum et al. |
| 6,527,379 | B1 | 3/2003 | Martin |
| 6,575,566 | B1 | 6/2003 | Jeanmaire et al. |
| 6,588,339 | B2 | 7/2003 | Naniwa et al. |
| 6,666,548 | B1 | 12/2003 | Sadasivan et al. |
| 6,824,241 | B2 | 11/2004 | Sonnichsen et al. |
| 7,182,420 | B2 | 2/2007 | Nakazawa |
| 2001/0017103 | A1 | 8/2001 | Takeshita et al. |
| 2003/0016264 | A1 | 1/2003 | Jeanmaire |
| 2003/0016276 | A1 | 1/2003 | Jeanmaire |
| 2003/0202055 | A1 | 10/2003 | Jeanmaire et al. |
| 2004/0017421 | A1 | 1/2004 | Jeanmaire |
| 2004/0036735 | A1 | 2/2004 | Garbacz et al. |
| 2004/0066428 | A1 | 4/2004 | West et al. |
| 2005/0116970 | A1 | 6/2005 | Nakazawa |
| 2006/0197810 | A1 | 9/2006 | Anagnostopoulos et al. |
| 2006/0203054 | A1 | 9/2006 | Matsuda et al. |
| 2006/0216426 | A1 | 9/2006 | Brown |
| 2007/0052779 | A1 | 3/2007 | Cho |
| 2008/0100660 | A1 | 5/2008 | Perrin et al. |
| 2009/0040248 | A1 | 2/2009 | Matsuda et al. |
| 2009/0040283 | A1 | 2/2009 | Matsuda et al. |
| 2009/0189964 | A1 | 7/2009 | Nagamine et al. |

FOREIGN PATENT DOCUMENTS

| | | |
|---|---|---|
| GB | 1 553 720 | 10/1979 |
| GB | 2 098 546 | 11/1982 |
| GB | 2129 374 | 5/1984 |
| GB | 2 337 961 | 12/1999 |
| GB | 2 447 919 | 10/2008 |
| JP | 52-037040 | 3/1977 |
| JP | 56-101865 | 8/1981 |
| JP | 56-150584 | 11/1981 |
| JP | 60-011364 | 1/1985 |
| JP | 60-11364 | 1/1985 |
| JP | 63-122545 | 5/1988 |
| JP | 01-247167 | 10/1989 |
| JP | 10-202898 | 8/1998 |
| JP | 10-324000 | 12/1998 |
| JP | 2000-094657 | 4/2000 |
| JP | 2004-322558 | 11/2004 |
| WO | WO 93/17868 | 9/1993 |
| WO | WO 93/17869 | 9/1993 |
| WO | WO 99/62717 | 12/1999 |

OTHER PUBLICATIONS

USPTO Office Action dated Mar. 22, 2011 in U.S. Appl. No. 12/576,916.

USPTO Office Action dated Feb. 2, 2011 in U.S. Appl. No. 12/074,171.

Office Action dated Aug. 17, 2010 issued in U.S. Appl. No. 12/074,171 which corresponds to U.S. Pub. No. 2009/0189964.

Imaje. "S8 Master Printer", dated Feb. 2001.

Markem-Imaje. "S8 Master Printer", dated Sep. 6, 2006.

INK JET PRINTING

RELATED APPLICATIONS

This is a division of U.S. patent application Ser. No. 12/532,094, filed on Sep. 18, 2009, now U.S. Pat. No. 8,388,118, which is a U.S. National Phase under 35 U.S.C. §371 of International Application No. PCT/GB2008/000836, filed on Mar. 12, 2008, and claims the priority of Great Britain application No. 0705902.5, filed on Mar. 27, 2007, the entire content of which is hereby incorporated by reference.

FIELD OF THE INVENTION

The present invention relates to continuous ink jet printers and printheads therefor, and also to methods of operating them.

BACKGROUND OF THE INVENTION

During operation of a continuous ink jet printer, a continuous stream of ink drops is generated and means are provided for deflecting the drops in flight, so that different drops can travel to different destinations. Since the drops are generated continuously, only some of the drops will be required for printing. Accordingly, the drops required for printing are arranged to travel in a direction so that they reach the surface to be printed onto, whereas drops which are not required for printing are arranged to travel to a means, usually known as a gutter, where they are collected. In almost all modern continuous ink jet printers, ink collected at the gutter is returned to an ink tank, from which ink is supplied to the means (sometimes called the ink gun) which creates the stream of ink drops. Ink jet printers of this type are used for a wide variety of printing and marking purposes, such as printing "sell by" and batch information on food containers and printing identification and other variable data on industrial products and packaging.

Typically, the ink is electrically conductive when wet, and an arrangement of electrodes is provided to trap electric charges on the ink drops and create electrostatic fields in order to deflect the charged drops. The ink gun, the various electrodes and the gutter are fixed in the appropriate spatial relationship in a printhead. Various tanks, pumps, control circuits and the like are housed within a printer body, and the head is usually connected to the body by a flexible conduit carrying fluid lines and electrical wiring, which may be a few meters long.

The ink contains one or more colouring substances together with various other components, carried in a solvent such as methylethylketone or, in the case of inks for food use, ethanol. The solvent is highly volatile, to ensure that the printed ink drops dry quickly. Consequently, the solvent has a tendency to evaporate from the ink during operation of the printer, so that the ink in the ink tank becomes too concentrated. Accordingly, a typical ink jet printer will also have a tank of spare solvent, also housed in the main body, and an arrangement for monitoring ink viscosity directly or indirectly. When the viscosity exceeds a predetermined level, a small dose of solvent will be transferred from the solvent tank into the ink tank to dilute the ink.

In order that the ink collected by the gutter should be conveyed along the gutter line away from the gutter, suction is usually applied to the gutter line from a suction source, typically in the main printer body. The fluid travelling along the gutter line will be a mixture of ink and air. Air inevitably enters the gutter both as a result of the suction applied to the gutter line and because the ink drops moving through the air from the ink gun to the gutter inevitably entrain some air in their path. This mixture of ink and air is delivered to the ink tank.

In order to maintain the ink and solvent tanks at the correct pressure, they may both be vented to allow air to flow in and out of the tanks. Each tank may be vented independently, or alternatively the ink tank may be vented to the solvent tank and the solvent tank may be vented to atmosphere. The air which enters the ink tank with the ink recovered from the gutter is therefore able to escape through the venting arrangement.

Even in the case of printers in which the ink and solvent tanks are pressurised, such as the arrangement of DE-A-3607237, an arrangement must be provided for venting the air which has entered through the gutter.

It is also known to deliver the mixture of ink and air from the gutter to a settling tank, rather than directly to the ink tank, to allow the ink and air to separate before the ink is returned to the ink tank. This can be useful in cases where the ink tends to foam or there is a tendency for very small air bubbles to be mixed into the ink. In this case, the air which has entered through the gutter may be vented from the settling tank without passing through the ink tank.

In the operation of a continuous ink jet printer the loss of solvent through evaporation takes place almost entirely through the air which enters the gutter, because the intimate contact of that air with the ink in the gutter line means that the air tends to be highly laden with solvent vapour when it is discharged to atmosphere.

U.S. Pat. No. 4,023,182 proposes a tank, to allow the air and ink to separate, connected to the gutter by a short tube of relatively large diameter. The air is discharged from the tank through another large diameter tube to a vacuum source which is principally responsible for the suction applied to the gutter. The ink is transferred separately through a relatively narrow diameter tube to an evacuated ink return tank. This arrangement is intended to minimise the extent to which the air and ink can mix before they are separated in the tank, so as to reduce the amount of solvent that evaporates from the ink.

WO02/100645 proposes an arrangement for minimising the formation of an ink-air foam or emulsion in the gutter line, in order to avoid the build-up of such a foam or emulsion in the ink tank. It provides a gutter specially shaped to allow drops to form a liquid film and then a pool of ink with little splashing of the drops on impact. The build-up of the ink pool at the gutter is monitored and suction is applied to the gutter line only when there is ink to be evacuated. This arrangement reduces the extent to which the ink and the air mix, and also reduces the total amount of air sucked through the gutter line. It mentions controlling the manner of switching suction to the gutter line in order to minimise consumption of solvent.

WO99/62717 proposes to apply only an intermittent or pulsed suction to the gutter rather than steady, continuous suction. This is stated to reduce the amount of solvent lost from the ink, because of the reduction in the amount of air sucked into the ink system from the gutter. It also proposes that the mixture of ink and air passing from the gutter to the ink tank or alternatively the air being discharged from the ink tank may be cooled or otherwise treated to reduce the level of solvent droplets and/or vapour discharged to the environment.

EP-A-0076914 proposes that the vacuum source should apply only a very low level of suction (e.g. about ten centimeters of water) to the gutter, in order to minimise the flow of air along the gutter line and thereby reduce the rate of evaporation of solvent from the ink. It additionally proposes that the ink should be cooled before it is supplied to the ink gun, in order to reduce the rate of evaporation at the printhead.

Proposals to cool the mixture of ink and air flowing from the gutter, or to cool the air before it is discharged to atmosphere, in order to condense solvent out of it are also disclosed in JP-01-247167, EP-A-0805038, U.S. Pat. No. 5,532,720, WO93/17868, WO93/17869 and WO94/07699.

Condensation of solvent vapour from vented air is used in practice in the A200, A300 and A400 ink jet printers available from Domino UK Limited, Trafalgar Way, Bar Hill, Cambridge CB3 8TU, which optionally include a Peltier device arranged to cool air flowing out of the ink tank so as to condense solvent vapour in the air. The condensed solvent is discharged to the solvent tank and the air is vented. This reduces the rate at which the printer consumes solvent.

The reduction of solvent consumption is useful, partly because solvent consumption represents a significant cost in the running of a continuous ink jet printer, and also because (as will be clear from the examples given above) the solvents tend to be volatile organic compounds and therefore solvent discharge to the atmosphere is environmentally disadvantageous. However, it needs to be borne in mind in the design of any arrangement for recovering evaporated solvent by condensation that excessive cooling of solvent-laden air will tend to cause water to condense in addition to solvent, and the introduction of water into the ink or solvent is highly undesirable in most continuous ink jet printer ink compositions.

U.S. Pat. No. 4,283,730 and U.S. Pat. No. 4,356,500 propose a system in which the air which has passed down the gutter line is returned to the space enclosed by the printhead cover, so that the air within the printhead cover becomes substantially saturated with solvent. This is intended to prevent ink from evaporating from the ink jet while it is in the space enclosed by the cover, so as to reduce solvent consumption, and also to prevent ink splashes at the printhead from drying. It proposes that, if the ink jet is cooler than the air within the printhead cover, there may be recondensation of solvent into the ink jet. It also proposes that electrodes may be heated slightly to prevent solvent from condensing on them. However, the present inventors consider that in many ink jet printer designs it is desirable for ink splashes to dry as quickly as possible, rather than to be prevented from drying, because the electrically conductive nature of wet ink tends to interfere with the correct functioning of printhead electrodes. It may be noted that U.S. Pat. No. 4,283,730 and U.S. Pat. No. 4,356,500 relate to an uncommon printhead design in which ink drops make grazing contact with a curved surface and then drops to be printed separate from the surface again under centrifugal force.

U.S. Pat. No. 4,184,167 concerns a continuous ink jet printer in which the gutter is provided by a knife-edge at the end of one of the electrodes used to create the deflection field. The surface of the electrode is porous stainless steel and the ink is sucked through it by a vacuum pump. The air which is also sucked through the electrode becomes laden with solvent and is then delivered to the other electrode used to create the deflection field. The solvent laden air passes through the porous stainless steel face of this electrode to provide a barrier to prevent stray ink drops from adhering to and drying on the surface of that electrode, and also prevents the drying of ink drops which have contacted the surface of the first electrode before reaching the gutter-forming knife-edge, so that the drops remain liquid and are sucked through the electrode by the vacuum source.

EP-A-0560332 proposes that air which has passed from the gutter into the ink tank and is then vented from the ink tank should be cooled, to recover some of the vaporised solvent, and then the air is returned to the printhead outside the gutter. Accordingly the air which is sucked into the gutter is air which has previously passed through the gutter, the ink tank and the cooler before being returned to the printhead. Consequently, the same air circulates continuously within the printer. Since air does not flow out of the printer, solvent loss is substantially prevented.

WO93/17869 also proposes that air vented from the ink tank may, after being cooled to recover vaporised solvent, be vented at the printhead adjacent the ink nozzles so that residual solvent vapour remaining in the air is carried with the stream of ink droplets and sucked into the gutter so as to minimise the escape of solvent vapour into the environment.

Although these arrangements for returning air which has entered the gutter back to the printhead are, in theory, effective for reducing solvent loss, in practice they will tend to result in the condensation of solvent on electrodes and other parts of the printhead unless steps are taken to avoid this such as heating the electrodes and other parts as proposed in U.S. Pat. No. 4,283,730 and U.S. Pat. No. 4,356,500 or removing some of the solvent vapour from the air as proposed in EP 0560332 and WO93/17869 with result that the air returned to the printhead is not fully saturated.

Because the ink is normally electrically conductive when wet, and is controlled by being given an electric charge and steered by electric fields, condensation of solvent on parts of the printhead can disrupt the electrical deflection operation, either by distorting the shape of electrical fields or by shorting electrodes, or may interfere in other electrical operations such as electrically sensing charged drops during jet speed measurement or other control operations.

SUMMARY OF THE INVENTION

In an aspect of the present invention, an ink jet printer has means to vent at least some of the air, that has passed along a line together with ink received by the gutter, and also has means to feed at least some of the air back to pass along the line again.

In another aspect of the present invention, air that has passed along a line with ink received by the gutter is fed back to join the ink flow at a point downstream of the ink's entry to the gutter.

In one aspect of the invention, air that has passed along a line with ink received by the gutter is partly fed back to pass along the line again and is partly vented, and an arrangement is provided for varying the relative proportions of the fed-back air and the vented air. In some embodiments either or both proportion may be varied to zero.

Aspects of the invention are set out in the claims.

In an aspect of the present invention a line carrying part of the air which has already passed along the gutter line opens into the gutter or gutter line shortly downstream of the gutter opening. In this way, the air is recirculated back into the gutter line. Preferably the junction is no more than 10 mm downstream of the gutter opening, more preferably no more than 5 mm from the opening and most preferably in the range of 1 mm to 2 mm from the opening (measured from the gutter opening along the flow path of ink to the nearest edge of the passage or bore carrying the air at its junction with the ink flow path). By connecting this supply of recirculated air, which has already passed along the gutter line, directly to the gutter or the gutter line, it is not vented at all and therefore does not escape to atmosphere. However, it is not possible to recirculate 100% of the air that passes down the gutter line as an allowance has to be made for air that will inevitably enter the gutter opening by entrainment with the ink drops even in the absence of any suction at the opening. If an attempt is made to recirculate 100% of the air passing along the gutter line back into it, this will tend to stop the flow of the ink into the gutter line with result that ink begins to dribble out of the gutter opening instead of passing reliably into the gutter line.

Because the line carrying recirculated air opens into the gutter or gutter line, rather than opening into the air at the printhead, the recirculated air does not come into contact with electrodes and other elements of the printhead and so does not tend to cause solvent condensation on them even if the recirculated air is heavily laden with solvent.

The maximum proportion of the air from the gutter line which can be recirculated back into it will vary depending on the precise design and operating conditions of the printer, and particularly the design and operating conditions of the gutter. However, experiments conducted by the applicant on its own design of printhead suggest that typically the maximum amount of gutter line air that can be recirculated while still enabling the gutter to receive ink drops effectively is in the region of 90-95%, but this figure is strongly influenced by the distance between the gutter opening and the point where the recirculated air is introduced into the gutter flow.

This was measured by dividing the line carrying air for recirculation so as to form two branches. One branch was connected so that the air carried by it was recirculated into the gutter. The other branch was vented to atmosphere. Each branch was fitted with a needle valve and a flow meter. The relative flow down the branches was varied by adjusting the needle valves and measured by comparing the flow meter readings. The proportion of air being recirculated was increased until the gutter failed to clear the ink entering it from the ink jet.

In practical operation of a printer the operating conditions such as temperature, ink viscosity etc. may change, and the flexible conduit connection between the printhead and the printer body means that the printhead can be fixed at a variety of heights relative to the printer body, which also affects gutter performance. For these reasons, it is preferred in practice to recirculate rather less air than the theoretical maximum possible amount, so as to allow some leeway for variations in operating conditions. Therefore it would normally be reasonable to recirculate 50% to 75% of the air from the gutter line. Even this level of recirculation results in a substantial reduction in the amount of solvent vented to atmosphere and lost to the system. It will also be appreciated by those skilled in the art that the part of the air from the gutter line which is vented rather than being recirculated can be subjected to other solvent recovery processes if desired, such as being cooled to condense solvent vapour, thereby further reducing the amount of solvent vented to atmosphere.

In another aspect of the present invention an arrangement may be provided to vary the proportion of the air from the gutter line which is returned to the printhead for recirculation into the gutter line, enabling an increased amount, or even all, of the air from the gutter line to be vented to atmosphere instead of passing back into the gutter line. This aspect is not limited to connecting the recirculated air directly into the gutter or gutter line, but can also be applied to other systems that recirculate gutter air back to the printhead such as those shown in U.S. Pat. No. 4,283,730, U.S. Pat. No. 4,356,500, EP 0560332 and WO93/17869. This aspect enables a temporary increase in the rate of evaporation of solvent from the ink. This may be desirable if, for some reason, the ink has become over-dilute. There are various reasons why this can happen. For example, in some designs of continuous ink jet printer the ink gun is flushed with solvent on at least some occasions when the ink jet is stopped. This ensures that the ink gun is not left with ink in it while the jet is not running, in case ink dries inside the gun causing a blockage. However, this flushing process typically results in a small volume of pure solvent or highly dilute ink being added to the ink tank. If this process is carried out too frequently, without an adequate period of normal jet operation in between, the repeated addition of solvent to the ink tank can over-dilute the ink. In this case, it may be useful to allow solvent to evaporate from the ink until the ink composition has returned to within preferred limits.

BRIEF DESCRIPTION OF THE DRAWINGS

Embodiments of the present invention, provided as non-limiting examples, will be discussed with reference to the following drawings.

DETAILED DESCRIPTION OF THE DRAWINGS

Figure 1:
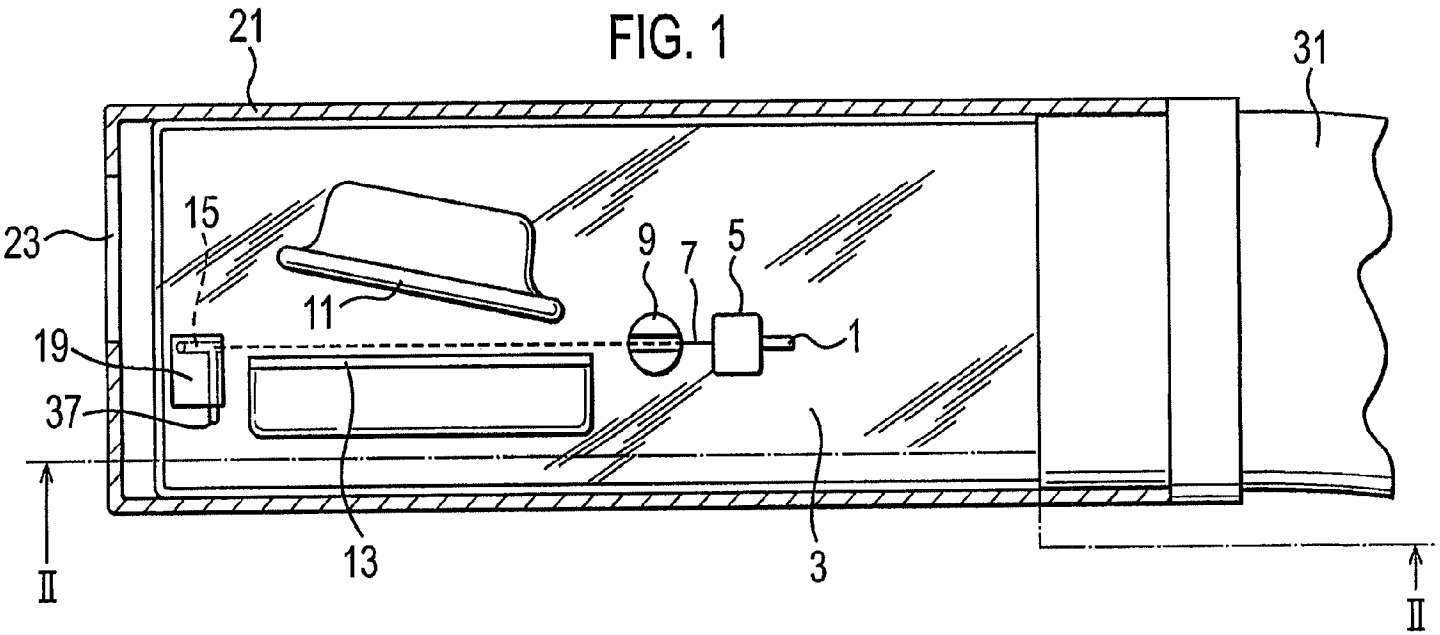
FIG. 1 is a plan view of a printhead according to a first embodiment of the present invention.
Figure 2:
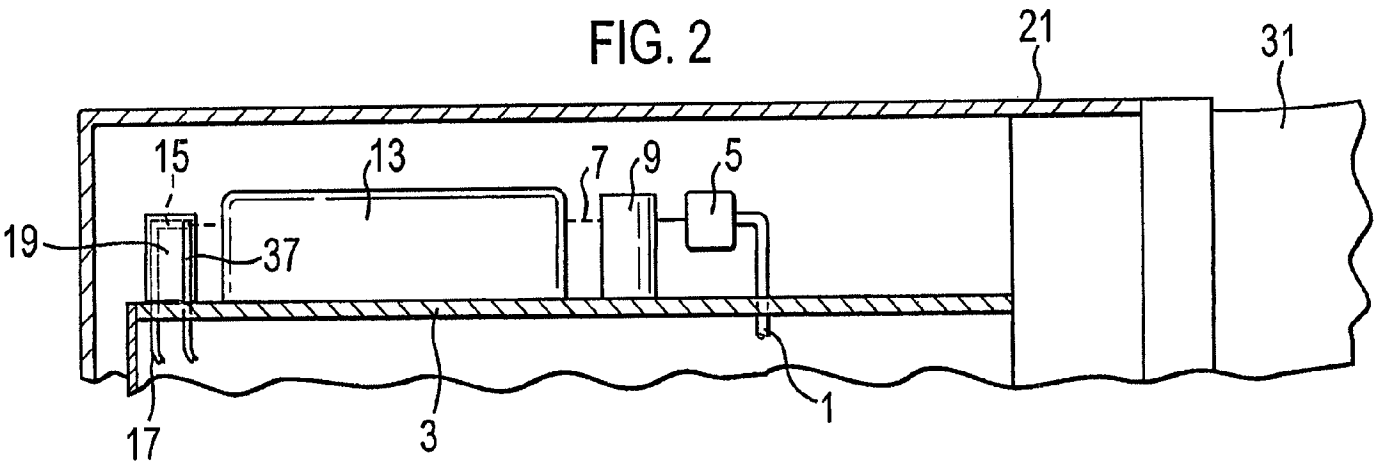
FIG. 2 is a side view of the printhead of FIG. 1.

FIG. 1 is a plan view of a printhead for a continuous ink jet printer, according to a first embodiment of the present invention. FIG. 2 is a partially cut away side view of the printhead of FIG. 1. In operation of the printer, pressurised ink is continuously supplied to an ink gun in the printhead. In a cavity in the main part of the ink gun (not shown in the Figures), the ink is subjected to continuous pressure oscillation by a vibrating piezoelectric transducer, to control the way in which the ink jet breaks into drops. The ink, now subject to the pressure oscillations, travels along a pipe 1 through a supporting substrate 3, on which many of the components of the printhead are mounted, to a nozzle portion 5 of the ink gun. The ink jet 7 is formed as the pressurised ink leaves through a jet-forming orifice in the nozzle portion 5.

Initially, the ink jet 7 is a continuous unbroken stream of ink, but it separates into individual drops of ink, under the influence of the pressure oscillations created by the piezoelectric transducer, a short distance downstream from the nozzle portion 5, while the jet is passing through a slot in a charge electrode 9. The ink is arranged to be electrically conductive, and the ink in the nozzle portion 5 is held at a constant voltage (usually earth). Accordingly, any voltage applied to the charge electrode 9 will induce a corresponding electrical charge in the part of the continuous unbroken jet which is in the slot of the charge electrode 9. As the end of the continuous stream breaks off to form a new ink drop, any electric charge in the volume of ink that is breaking off becomes trapped as the ink drop separates from the continuous stream. In this way, the voltage on the charge electrode 9 controls the amount of charge trapped on each drop, and varying the signal supplied to this electrode varies the charge trapped on the ink drops.

After leaving the charge electrode 9, the drops of ink pass between two deflection electrodes 11, 13. A substantial potential difference between these electrodes (typically several thousand volts) creates a strong electric field, which deflects the drops of ink to an extent which varies depending on the amount of charge trapped on each drop. Uncharged drops will pass through the electric field undeflected. In this way, the eventual path of each ink drop as it leaves the field between the deflection electrodes 11, 13 depends on the charge trapped on the drop by the charge electrode 9, which in turn depends on the signal voltage which was applied to the charge electrode 9 at the moment when that drop separated from the continuous part of the jet. In this way, individual drops can be steered to the desired destination, to enable printing.

Since the jet is running continuously, but only some drops will be required for printing, a gutter 15 is provided to catch the unwanted drops (which will in practice be the overwhelming majority of ink drops in normal operation). Usually, the gutter is positioned so as to catch undeflected drops, as shown in FIG. 1. This has the advantage that if the jet is running while no signal is applied to the charge electrode 9 or the deflection electrodes 11, 13, the jet will run to the gutter rather than soiling the printhead or nearby items. The gutter 15 is connected to a gutter line 17, to which suction is applied so as to suck away the ink that enters the gutter 15. Normally, this ink is returned to an ink tank in the printer, from which the ink gun is supplied.

Many alternatives are known for the detailed construction of the printhead of a continuous ink jet printer. In the present case, the deflection electrode 11 is formed as a solid piece of metal, whereas the deflection electrode 13 is formed as a thin metal layer printed on a ceramic substrate, which is in turn mounted on a support. At each end of the ceramic substrate a separate conductive layer is printed, insulated from the layer forming the deflection electrode, and these additional areas form sensing electrodes which detect the passage of charged ink drops past them. This arrangement is used in a known manner to detect the time it takes the drop to pass from one sensing electrode to the other, and in this way the speed of the ink jet 7 can be determined. Further details of this construction, combining sensing electrodes and a deflection electrode on a single ceramic substrate, are set out in EP-A-1079974 and U.S. Pat. No. 6,357,860. For convenience in the design and operation of the electronics for the sensing electrodes, the deflection electrode 13 is held at ground potential and the deflection electric field is formed by applying a high voltage to the other deflection electrode 11.

Various arrangements are known for constructing the gutter of a continuous ink jet printer. In the present embodiment, the gutter 15 is formed by drilling holes in a solid gutter block 19 mounted on the supporting substrate 3. This arrangement facilitates precision manufacturing and accurate positioning of the gutter 15 during assembly of the printhead.

A printhead cover 21 is fitted over the operating parts of the printhead. In FIGS. 1 and 2 the printhead cover 21 is shown in section to enable the other components to be seen. The cover 21 has a slot 23 in its end surface so that ink drops which have been deflected sufficiently to miss the gutter 15 and gutter block 19 can pass out through the slot 23 to be printed.

Figure 3:
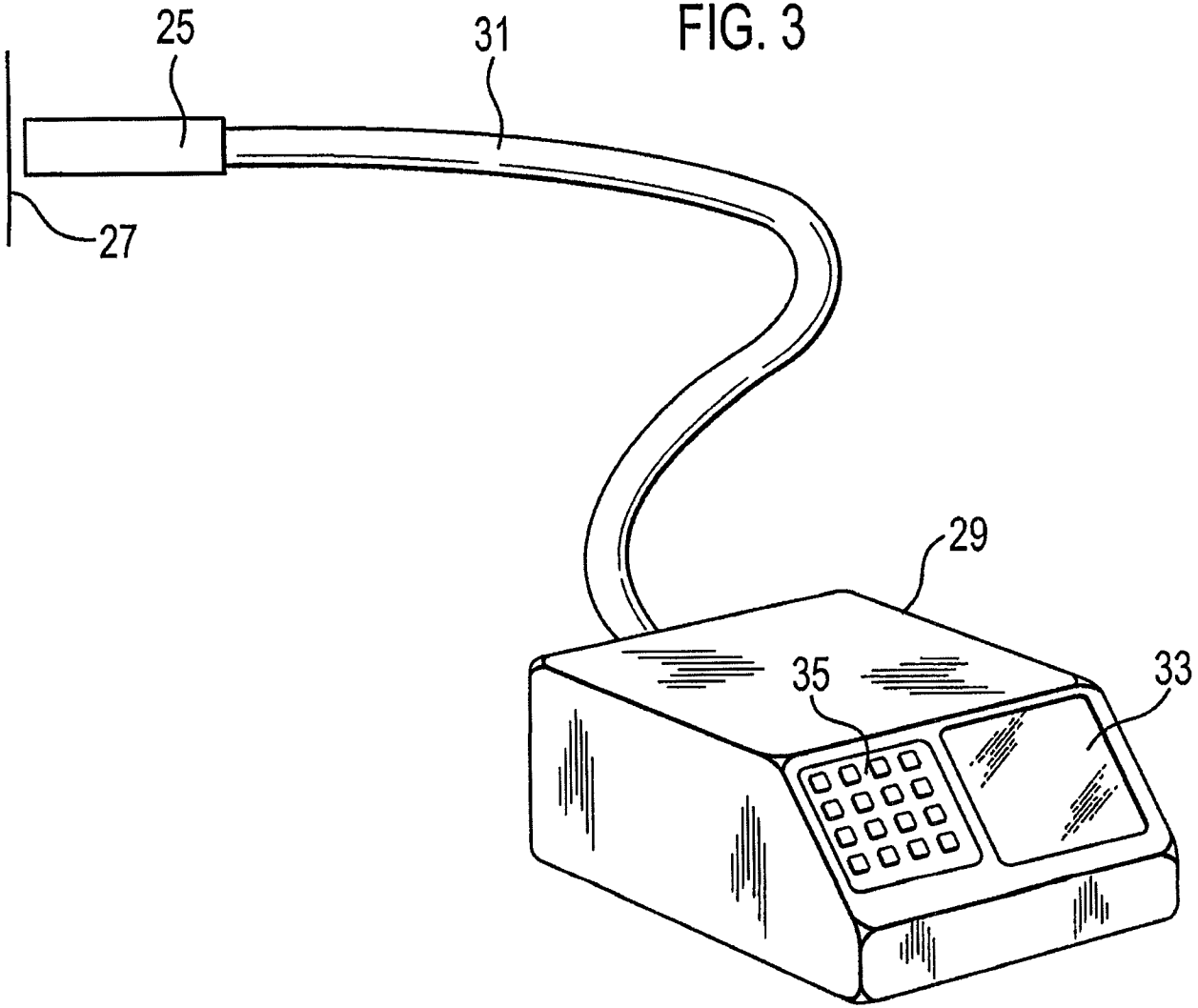
FIG. 3 shows schematically an ink jet printer embodying the present invention.

FIG. 3 is an overall view of the ink jet printer as a whole. The printhead 25 is positioned facing the surface 27 to be printed onto. The surface 27 is arranged to move past the printhead 25, and may for example be a packaging carton, a succession of articles such as jam jars, or a continuous length of extruded tubing. The printhead 25 is connected to the main printer body 29 by a flexible conduit 31. The main body 29 contains tanks for ink and solvent, pumps and valves for the fluid system, and control electronics. It has a display 33 and a keypad 35 for use by an operator. The conduit 31 carries fluid lines, such as an ink supply line and the gutter line 17, to connect the fluid system in the main body 29 to the fluid system components in the printhead 25. The conduit 31 also carries various electrical lines which provide the necessary connections to the electrical components in the printhead 25 such as the charge electrode 9 and the deflection electrodes 11, 13.

Returning to FIGS. 1 and 2, the suction applied to the gutter line 17 sucks air into the gutter 15 in addition to sucking away ink drops that have entered the gutter. Even without this effect of the suction, the ink jet 7 entrains air owing to its movement, and so the ink drops passing in to the gutter 15 also pull in entrained air. Accordingly, as long as the suction is provided, a stream of air or a mixture of air and ink passes along the gutter line 17. This mixture is delivered to the ink tank in the main printer body 29, where the ink separates from the air and joins the remainder of the ink in the tank. As an alternative, it is possible to pass the air/ink mixture to a settling vessel, in which the air and ink may separate, so that the ink returned to the ink tank is substantially free of bubbles. In either case, the suction of air into the gutter 15 and along the gutter line 17 means that there is a continuous entry of air into the fluid system of the printer, which must then be disposed of. This air comes into intimate contact with the ink as it passes along the gutter line 17. Inks for continuous ink jet printers are often complex mixtures of many substances, but a large part of the volume will normally be a highly volatile solvent. The solvents are highly volatile in order to allow the printed drops to dry quickly. Typically solvents will be based on methylethylketone, acetone, ethanol or mixtures thereof. Consequently, by the time the air that has passed along the gutter line 17 is separated from the ink, it is normally saturated with evaporated solvent. If this air is then discharged to the atmosphere, there is a loss to the operator who has to replace the missing solvent to keep the ink at the correct composition, as well as environmental pollution.

In order to reduce the amount of evaporated solvent discharged to the environment, some of the air which has passed along the gutter line 17 is, after separation from the ink, returned to the printhead 25. It then passes through a pipe 37 connected directly to the interior of the gutter 15, just downstream of the ink-receiving orifice. Therefore some of the air passing along the gutter line 17 is recirculated air that has already passed along it previously, and already carries evaporated solvent. This reduces the tendency of solvent to evaporate out of the ink in the gutter line 17. The pipe 37 does not open into the volume enclosed by the printhead cover 21. This avoids any tendency for solvent carried by the recirculated air to condense on the printhead components or to pollute the environment around the printhead.

However, it has been found that it is not possible to recirculate 100% of the air that passes along the gutter line 17. Because the recirculated air passes directly from the pipe 37 into the gutter 15 it does not pass through the ink-receiving orifice of the gutter. However, as mentioned above the ink drops entering the gutter 15 inevitably entrain some air which is also dragged into the gutter. As a minimum, a corresponding amount of air must be continually discharged to atmosphere or else the volume of air being recirculated would always be increasing. In practice, if all of the air from the gutter line 17 is recirculated through the pipe 37 to the gutter 15, the air pressure and air flow patterns at the ink-receiving orifice of the gutter 15 are such that the ink does not reliably enter the gutter 15 and may dribble out.

Because of the many gutter constructions and fluid systems possible with continuous ink jet printers, it will normally be necessary to optimise any particular design by trial and error. However it is generally preferable for the point at which the recirculated air joins the path of ink from the ink-receiving orifice of the gutter to and along the gutter line to be at a point not more than 10 millimeters from the ink-receiving orifice, more preferably not more than 5 millimeters from the orifice, and most preferably not more than 2 millimeters from the orifice.

Since the recirculated air provided along the pipe 37 provides some of the air sucked along the gutter line 17, there will be a correspondingly reduced inward flow of air through the ink-receiving orifice and along the path from the orifice to the junction where the recirculated air enters. This reduced air flow is correspondingly less able to transport the ink. There may also be some effect, on the ability to transport ink, of turbulence at the junction since the gutter line 17 is at less than atmospheric pressure, the pipe 37 carrying recirculated air is at greater than atmospheric pressure, whereas the ink-receiving orifice of the gutter 15 is at atmospheric pressure.

In general, the longer the distance between the ink-receiving orifice and the junction where recirculated air enters, the greater the air flow that is required to enter through the ink-receiving orifice in order to clear the ink reliably, and consequently the smaller the proportion of ink passing along the gutter line 17 that can be recirculated.

With any individual ink jet printer design, it is a matter of trial and error to try various different positions at which the recirculated air joins the path of the ink that has entered the gutter and to try various different arrangements for controlling how much of the air that has passed along the gutter line can be recirculated, to determine the circumstances in which ink entering the gutter is cleared reliably and does not weep out of the gutter orifice at the printhead. Since the operating conditions of ink jet printers vary, and the effectiveness of the gutter suction may be affected by various factors such as ink viscosity and any height difference between the printhead and the suction source, and since the amount of suction delivered by the suction source may also vary, it is advisable to include a margin of safety in operating conditions rather than seeking to operate with a system in which ink is only just sucked into the gutter 15 without dribbling.

Figure 4:
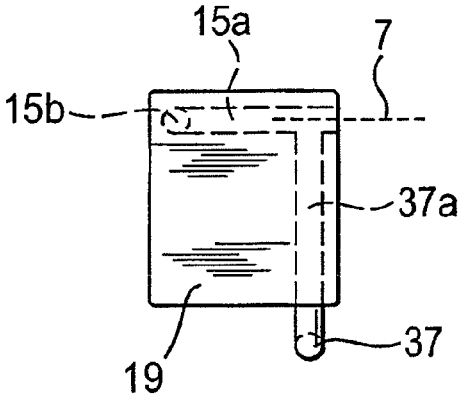
FIG. 4 is a top view of the gutter block of the printhead of FIGS. 1 and 2.
Figure 5:
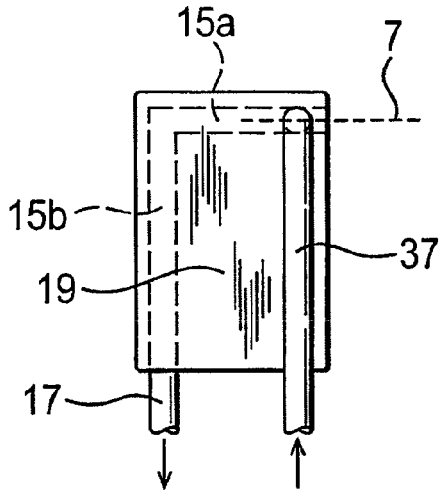
FIG. 5 is a side view of the gutter block of FIG. 4.
Figure 6:
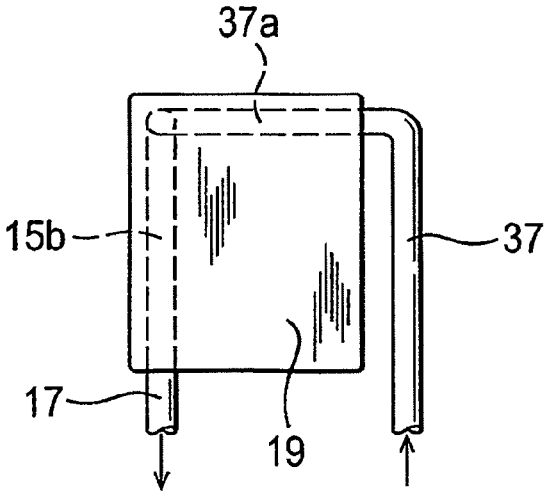
FIG. 6 is a rear view (looking towards the ink gun) of the gutter block of FIG. 4.

FIG. 4 is an enlarged top view of the gutter block 19 of the embodiment of FIGS. 1 and 2. FIG. 5 is a side view of the gutter block 19 and FIG. 6 is a view from the end of the printhead 25. The gutter 15 is made by drilling a bore 15*a* into the block from the front surface near the top of the block and adjacent one side of the block, and drilling another bore 15*b* up from the bottom of the gutter block 19 to meet the far end of the bore 15*a* remote from its opening, so as to create an enclosed ink path through the block. The opening of the bore 15*a* in the front surface of the gutter block 19 is the ink-receiving orifice of the gutter 15. As can be seen in FIG. 1, the position of the bore 15*a* adjacent one side of the gutter block 19 minimises the amount of deflection of the ink jet 7 that is required for ink drops to clear the gutter block 19 and be usable for printing.

The gutter block 19 can be precision-drilled before it is mounted on the supporting substrate 3 of the printhead, and it can be designed to be located accurately on the substrate 3, for example because the connection to the gutter line 17 passes through a pre-drilled hole in the supporting substrate 3. This provides a convenient arrangement for ensuring the correct placement of the ink-receiving orifice of the gutter 15 during manufacture. Such correct placement helps to ensure that the nozzle 5, the charge electrode 9 and the gutter 15 are correctly aligned with each other so that in the absence of any voltages on the charge electrode 9 and deflection electrodes 11, 13 the ink jet 7 will reliably enter the gutter 15 and avoid fouling the charge electrode 9.

The gutter line 17 is connected to the opening where the bore 15*b* enters the gutter block 19.

In order to allow recirculation of air into the gutter line, a further bore 37*a* is made from the side of the gutter block 19 so as to open into the bore 15*a* just behind the ink receiving orifice. This provides an enclosed air path in the block. The pipe 37, providing the recirculated air, is connected to the hole where the bore 37*a* enters the gutter block 19.

Figure 7:
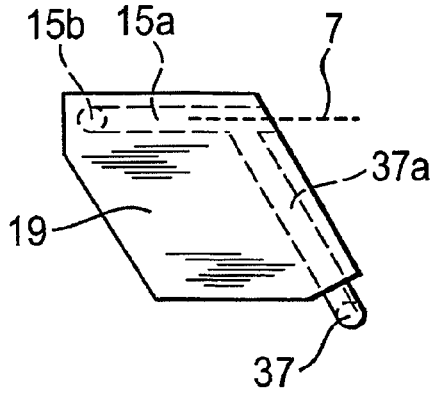
FIG. 7 is a top view of an alternative gutter block.

There is likely to be some turbulence in the air at the point where bore 37*a* opens into bore 15*a*, arising from the differences in the air pressures in the bores and because the flow of air from the bore 37*a* enters the bore 15*a* at 90° to the direction of flow along the bore 15*a*. It is currently suspected that such turbulence has an effect on the proportion of the air passing along the gutter line 17 that can be recirculated back to the gutter along the line 37. It would be possible to modify the design, so as to angle the bore 37*a* slightly towards the direction of flow along the bore 15*a* in the hope that this would reduce turbulence at the junction. However, in order to provide both this angling of the bore 37*a* simultaneously with keeping the junction close to the ink-receiving orifice, it is necessary also to angle the front face of the gutter block 19. FIG. 7 is a top view of an example of a modified gutter block in which the front face of the block 19 and the bore 37*a* have been angled so that the air flowing from the bore 37*a* into the bore 15*a* turns less sharply.

Figure 8:
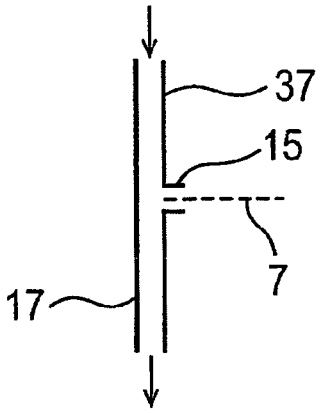
FIG. 8 shows a gutter configuration using a pipe.

A wide variety of gutter designs are possible. In principle it would be possible simply to provide a length of pipe, e.g. stainless steel, connected at one end to the gutter line 17 and connected at the other end to the recirculated air line 37, and having a hole in its side to act as the ink-receiving orifice. This provides an enclosed ink path from the hole to the gutter line 17, and an enclosed air path from the recirculated air line 37 to the position along the pipe where the hole is, at which position the air enters the ink path. However, it has been found in practice that in such a design the ink drops entering the pipe through the hole in the side tend to strike the far side of the pipe and, at least in part, splash back out through the orifice. In order to reduce this splashing, it is possible to fit a short length of pipe around the hole, to provide a construction as shown in FIG. 8. However, in this case the ink-receiving orifice is no longer the hole in the main pipe but is the open end of the side pipe, and as the side pipe is made longer to minimise splashing it also increases the distance between the ink-receiving orifice and the pipe junction. Since the interior of the side pipe is the region in which there is reduced air flow, because it does not carry any of the recirculated air, lengthening the side pipe to reduce splashing simultaneously reduces the ability of the suction on the gutter line 17 to clear ink entering the side pipe and therefore reduces the proportion of the total air passing down the gutter line 17 that can be recirculated to the line 37.

Figure 9:
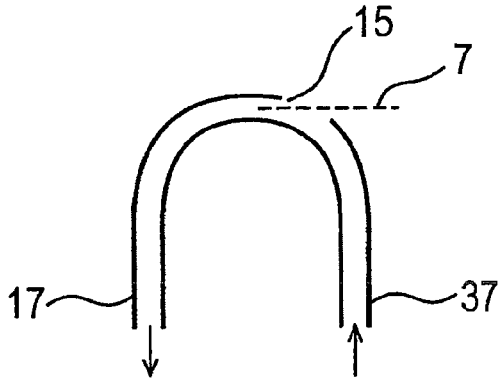
FIG. 9 shows a further gutter configuration using a pipe.

An alternative arrangement is shown in FIG. 9, in which the ink-receiving orifice of the gutter is formed as a hole in the side of a curved pipe joining the gutter line 17 and the air recirculation line 37. Because the ink enters a curved section of pipe in a near-tangential direction, it is less likely to splash back out through the hole by which it entered.

Figure 10:
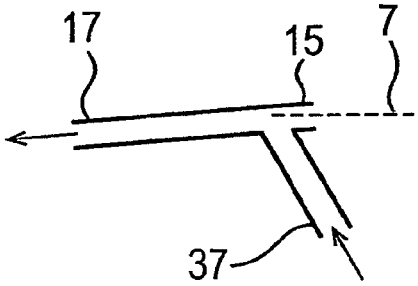
FIG. 10 shows yet a further gutter configuration using a pipe.
Figure 11:
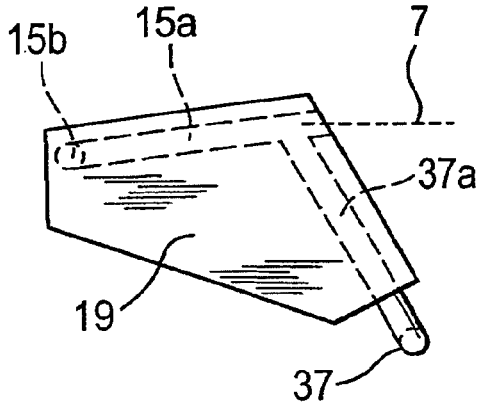
FIG. 11 shows a top view of yet a further example of a gutter block.

FIGS. 4 and 7 show the direction of the bore 15*a* as parallel with the direction of the ink jet 7. However, it is possible for the bore or pipe which the ink jet 7 enters to be angled slightly compared with the direction of the ink jet. In this case, the ink jet strikes the internal wall of the pipe or bore at an oblique angle to form a liquid film which can then coalesce and be sucked away along the gutter line 17. This slows the ink jet, and reduces the tendency of ink to splash out of the gutter orifice. FIGS. 10 and 11 show such arrangements, made using pipes and made using a gutter block 19, respectively.

Although embodiments of the gutter arrangement have been shown both made from pipes and made by forming bores in a gutter block 19, it is at present preferred to use the embodiments formed from a gutter block 19 for reasons of ease of manufacture, ease of mounting and robustness in use. The gutter constructions shown are merely examples, and a wide variety of arrangements are possible.

Figure 12:
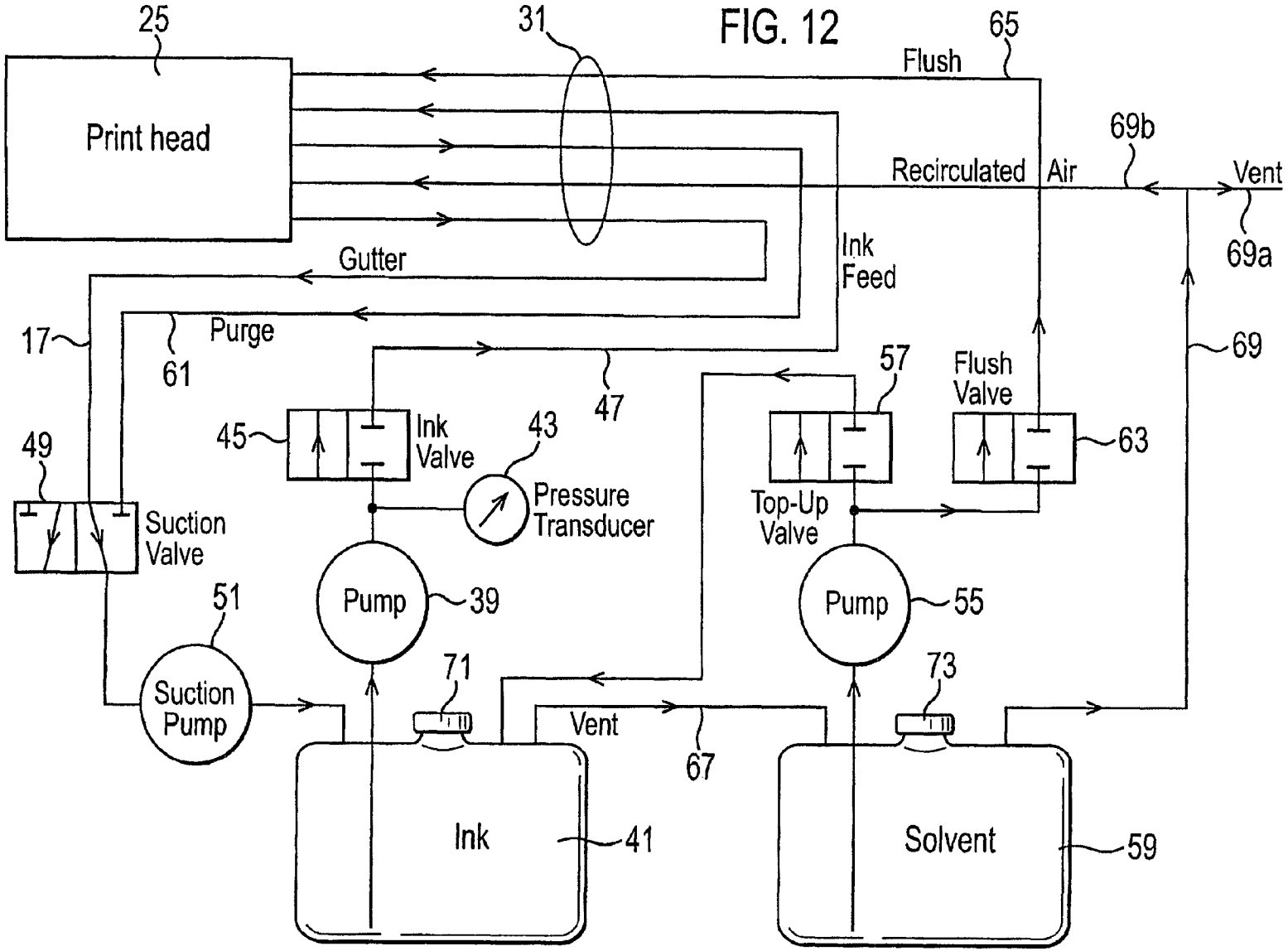
FIG. 12 is a schematic diagram of a fluid system for an ink jet printer embodying the present invention.

FIG. 12 is a conceptual schematic diagram of the fluid system for an ink jet printer embodying the present invention. In practice, there are many different ways in which a fluid system may be designed to perform the necessary operations, and in practice the applicants prefer at present to use a fluid system based on the schematic diagram of FIG. 13. However, the functions and operations of the fluid system are more easily understood with reference to FIG. 12.

During normal operation of the printer, while the ink jet is running, an ink pump 39 draws ink from an ink tank 41 and pressurises it. The pressure of the pressurised ink is measured by a pressure transducer 43. An ink valve 45 is placed in its open position, with result that pressurised ink flows along an ink feed line 47 through the conduit 31 to the printhead 25. The pressurised ink is supplied to the ink gun in order to form the ink jet 7 as described above with reference to FIGS. 1 and 2.

At the same time, the gutter line 17 is connected through a suction valve 49 to the inlet of a suction pump 51, so that suction from the suction pump 51 is applied to the gutter 15 in the printhead 25.

The velocity of the ink jet 7 is monitored in a known manner using the sensor electrodes combined with the deflection electrode 13 mentioned above with reference to FIGS. 1 and 2. The speed of the ink pump 39 is adjusted in order to keep the jet velocity within a desired range. In practice, it may be convenient to control the pump 39 in response to the output of the pressure transducer 43, so as to keep the ink at or near a target pressure, and the target pressure may be adjusted in order to keep the jet velocity in the desired range. As solvent evaporates from the ink, it becomes more viscous and the output pressure from the ink pump 39 has to increase in order to maintain the velocity of the ink jet 7. When a predetermined pressure limit is exceeded, a solvent pump 55 is operated and a top-up valve 57 is opened briefly to allow a small volume of solvent to be transferred by the solvent pump 55 from a solvent tank 59 to the ink tank 41, thereby diluting the ink slightly.

The suction valve 49 can be operated to switch the suction from the suction pump 51 from the gutter line 17 to a purge line 61. This line is connected to the interior of the ink gun in the printhead 25, allowing suction to be applied to the ink gun. This can be used for attempting to suck the ink nozzle clear if it has become blocked. Additionally, if the suction valve 49 is operated to switch suction to the purge line 61 simultaneously with the closure of the ink valve 45, thereby stopping the flow of ink along the ink feed line 47, the pressure of ink in the ink gun of the printhead can be lowered very abruptly, enabling the ink jet 7 to be stopped cleanly so as to minimise the soiling of the printhead with ink which would happen if the pressure of ink in the ink gun reduced more gradually.

If the printer is to be left for an extended period without the jet running, the printer may perform a cleaning routine in which, after the ink jet has been stopped, suction is maintained on the purge line 61 briefly to suck all the ink out of the ink gun and deliver it back to the ink tank 41. The suction valve 49 is then switched to apply suction to the gutter line 17, the solvent pump 55 is operated, and a flush valve 63 is opened to allow solvent to be pumped from the solvent tank 59 along a flush line 65 to the printhead 25. The flush line 65 delivers the solvent to the ink gun, and a jet of solvent is formed in place of the ink jet 7. The solvent jet enters the gutter 15 and the solvent is then sucked along the gutter line 17. This cleans both the ink gun and the gutter. Flush valve 63 is then closed and simultaneously the suction valve 49 switches suction to the purge line 61 again, so that the solvent in the ink gun is sucked along the purge line 61, cleaning the purge line. The pumps can then be turned off. This leaves the inside of the ink gun clean and empty, and the gutter and all lines exposed to the air are also clean, minimising the likelihood of an obstruction being formed by ink drying in the ink gun or the gutter while the jet is not running. However, it should be noted that the solvent used in this cleaning process is delivered by the suction pump 51 to the ink tank 41, thereby diluting the ink.

During normal operation of the printer, with the ink jet running, the suction pump 51 delivers a mixture of air and ink from the gutter line 17 to the ink tank 41. Consequently, the volume delivered to the ink tank 41 by the suction pump 51 greatly exceeds the volume removed from the ink tank 41 by the ink pump 39, and accordingly the suction pump 51 tends to pressurise the ink tank 41. In order to relieve this pressure, and allow the air from the gutter line 17 to escape, the ink tank 41 is vented by a vent line 67 to the solvent tank 59. The solvent tank 59 is in turn vented by an air recirculation line 69.

As shown in FIG. 12, this air recirculation line 69 branches, with one branch 69*a* allowing some of the air from the solvent tank 59 to vent to atmosphere while the other branch 69*b* conveys recirculated air to the pipe 37 in the printhead. However, as discussed above, the air recirculation pipe 37 in the printhead cannot carry all of the air which the suction pump 51 delivers to the ink tank 41. Accordingly, it is necessary to provide some arrangement for venting part of the air to atmosphere and this is most conveniently done by providing the branch 69*a* in the air recirculation line 69.

As ink and solvent are consumed during operation of the printer, the levels of ink and solvent in the respective tanks 41, 59 will fall. These tanks can be refilled by opening respective caps 71, 73. In the past, such tank caps have not always been completely airtight, thereby allowing an alternative path for air, which has entered the fluid system through the gutter, to be vented to atmosphere. Such an arrangement can also be provided in embodiments of the present invention in addition to or as an alternative to the branch 69*a* to atmosphere in the air recirculation line 69. However, unless the caps 71, 73 can be designed so that the amount of venting they permit is consistent or controllable, it is now preferred to make these caps airtight and to provide the venting to atmosphere through an arrangement such as the branch line 69*a* which allows the designer of the ink jet printer to control more easily the proportion of the air from the ink tank 41 which is recirculated to the printhead 25.

It should be noted that other arrangements for handling air from the ink tank 41 are possible. For example, the air recirculation line 69 can be connected so as to take air directly from the ink tank 41 rather than the solvent tank 59, so that the vent line 67 serves to vent the air space in the solvent tank 59, or the vent line 67 could be eliminated entirely and the solvent tank 59 could be vented to atmosphere separately. Since very little air would flow out of the solvent tank 59 if the air recirculation line 69 was connected directly to the ink tank 41, very little solvent would be lost if the solvent tank 59 was vented to atmosphere in an uncontrolled manner. Alternatively, the suction pump 51 could deliver the ink and air to a settling or separation tank, from which ink passes to the ink tank 41 and air passes directly to the air recirculation line 69.

The branch 69*a* to atmosphere in the air recirculation line 69 can be provided at any convenient location along the length of the air recirculation line 69, either at the main printer body 29 or at the printhead 25. The main consideration will be one of user convenience, and if desired the branch 69*a* may comprise or be connected to a hose or pipe to lead air away to an environmentally preferred venting location.

Figure 13:
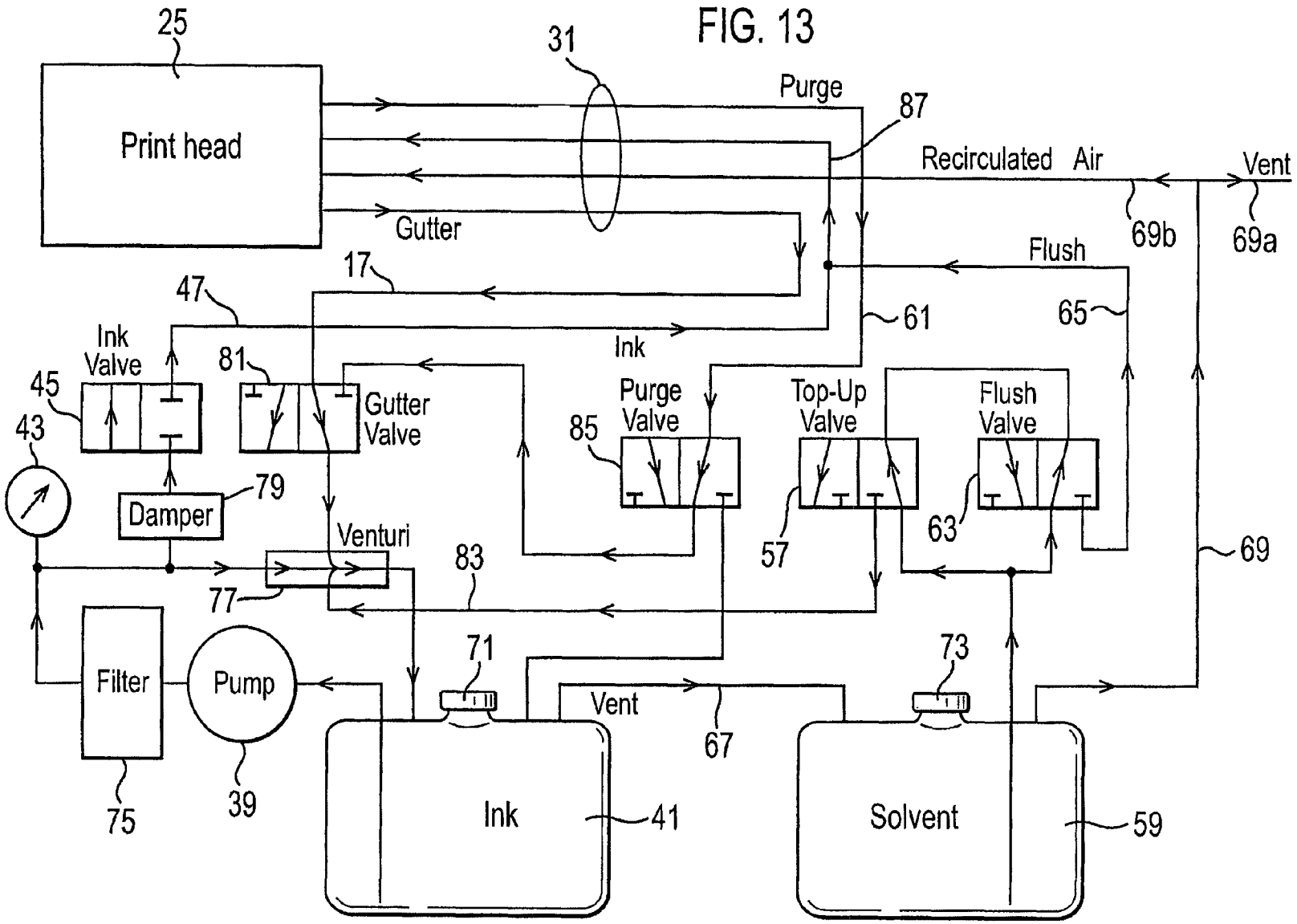
FIG. 13 is a schematic diagram of an alternative fluid system for an ink jet printer embodying the present invention.

As mentioned above, the fluid system of a continuous ink jet printer will normally be arranged to provide the functions described with reference to FIG. 12 but its components and interconnections may be different. FIG. 13 is a fluid system schematic diagram based on the actual fluid system of a Linx 4900 or Linx 6800 ink jet printer, modified so as to embody the present invention and simplified for ease of comprehension.

In FIG. 13 an ink pump 39 takes ink from an ink tank 41. On leaving the pump 39, the ink passes through a 10 micrometer filter 75, to protect the remainder of the fluid system from any particles which may have contaminated the ink in the tank 41. The pressure of the ink downstream of the filter 75 is monitored by a pressure transducer 43. The pressurised ink then flows through a Venturi suction device 77, in which the flow of ink through the device generates suction using the Venturi effect. Ink discharged from the suction device 77 is returned to the ink tank 41.

Between the filter 75 and the suction device 77, a branch supplies pressurised ink through a damper 79, which damps pressure vibrations in the ink caused by operation of the ink pump 39 and an ink valve 45 to an ink feed line 47. The pressurised ink in the ink feed line 47 travels to the printhead 25 and forms the ink jet 7. The jet speed is monitored, and the ink pressure provided by the ink pump 39 is controlled accordingly, as discussed with reference to FIG. 12.

During normal operation with the jet running, suction from the Venturi suction device 77 is applied to the gutter line 17 through a gutter valve 81, for clearing ink that has entered the gutter 15. Through the normal function of the suction device 77, the ink and air sucked along the gutter line 17 enters the stream of ink passing through the suction device, and therefore passes into the ink tank 41.

Suction from the Venturi suction device 77 is also applied to the top-up valve 57 via a top-up line 83. Normally, the top-up valve 57 closes the top-up line 83. When it is desired to add solvent to the ink, e.g. when the ink pressure required to maintain the correct ink jet velocity exceeds a threshold value, the top-up valve 57 is switched briefly. Consequently, the suction device 77 sucks solvent from the solvent tank 59 through the flush valve 63 and then through the top-up valve 57 into the top-up line 83. Through the action of the Venturi suction device 77, the solvent then joins the ink flowing through the suction device into the ink tank 41.

In order to provide the purge function described above with reference to FIG. 12, the gutter valve 81 may be switched to apply suction from the suction device 77 to the purge line 61 via a purge valve 85.

The purge valve 85 allows the purge line 61 to be vented to the ink tank 41 as an alternative to being connected to the gutter valve 81. This allows an additional mode of operation in which ink is pumped from the ink tank 41 along the ink feed line 47, passes to the printhead 25 and then returns along the purge line 61 and flows back into the ink tank 41, without any ink jet being formed in the printhead 25.

The flush line 65 from the flush valve 63 does not extend to the printhead 25 in the fluid system of FIG. 13, but instead the flush line 65 and the ink feed line 47 are joined within the main printer body 29, and a combined feed line 87 extends to the printhead 25. In order to provide the flushing function, the ink valve 45 is operated to stop the flow of ink along the ink feed line 47, the gutter valve 81 and the purge valve 85 are placed in positions so as to apply suction from the suction device 77 to the purge line 61, and the flush valve 63 is operated to open the flush line 65. Suction from the suction device 77 is applied via the purge line 61 to the interior of the ink gun in the printhead 25, and this applies suction to the feed line 87. This suction cannot suck ink from the ink feed line 47 because the ink valve 45 is closed. Instead, it sucks solvent from the solvent tank 59 through the top-up valve 57 and then through the flush valve 63 into the flush line 65. The solvent is then transported by the suction along the feed line 87, through the ink gun and back along the purge line 61, through the suction device 77 and into the ink tank 41. The suction is then shut off by operating the gutter valve 81, which returns suction to the gutter line 17. The flush valve 63 is operated to isolate the flush line 65, and the ink valve 45 is opened briefly to supply pressurised ink to the ink feed line 47 and the combined feed line 87. This drives some of the solvent already in the feed line 87 out of the orifice in the nozzle portion 5 of the ink gun, to form a brief solvent jet for cleaning the nozzle and the gutter 15.

The arrangements for venting air from the ink tank 41 and recirculating some of it to the printhead along an air recirculation line 69 are as described with reference to FIG. 12.

Various arrangements for branching in the air recirculation line 69 are discussed with reference to FIGS. 14 to 20.

Figure 14:
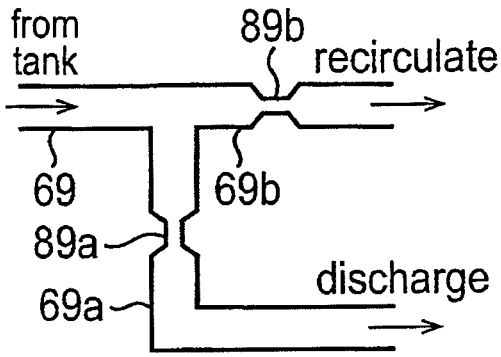
FIGS. 14 to 20 are schematic diagrams showing alternative detailed arrangements for the air recirculation branch and the vent branch in the air recirculation line of the fluid systems of FIGS. 12 and 13.

FIG. 14 shows a simple arrangement in which the air recirculation line 69 has a vent branch 69*a* through which some of the air is discharged to atmosphere, and a recirculation branch 69*b* which supplies recirculated air to the air recirculation pipe 37 in the printhead. Each branch has a respective flow restrictor 89*a*, 89*b*. By selecting the respective internal diameters of the flow restrictors, the system designer can exercise a degree of control over the proportion of the air in the recirculation line 69 that is discharged through the branch 69*a*. Although the flow restrictors 89*a*, 89*b* are shown close to the point where the recirculation line 69 branches in FIG. 14, this is not necessary and they can be placed at any convenient location along their respective branch lines. For example, the air recirculation line 69 may branch inside the main printer body 29, allowing the vent branch 69*a* to discharge solvent-laden air to atmosphere at the printer body or via a pipe to a desired location, whereas the flow restrictor 89*b* in the recirculation branch 69*b* may be provided at or near the printhead 25.

Figure 15:
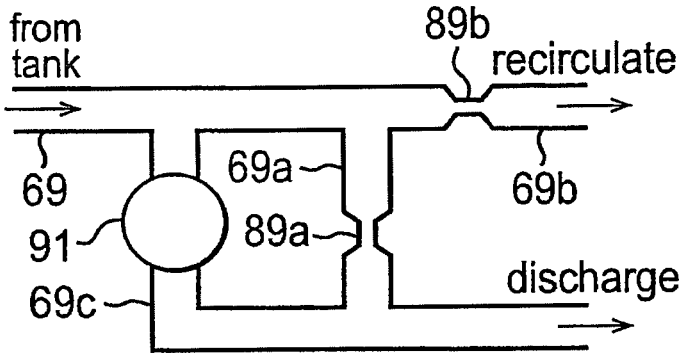

There may be occasions on which it is desired to encourage evaporation of solvent from the ink temporarily. For example, if the flushing operation described above with reference to FIGS. 12 and 13 is carried out repeatedly without normal operation of the ink jet for any significant period, the ink in the ink tank 41 may become overdiluted with solvent. Under these circumstances, it may be useful to reduce the amount of air from the gutter line 17 that is recirculated back to the printhead 25. FIG. 15 shows a modified branching arrangement for the recirculation line 69, to enable this to be done.

In FIG. 15, a bypass branch 69*c* is provided, to bypass the flow restrictor 89*a* in the vent branch 69*a* that discharges to atmosphere. A valve 91 in the bypass branch 69*c* can be selectively opened or closed in order to provide or remove the bypass effect. When the bypass valve 91 is open, air in the air recirculation line 69 can flow to atmosphere without passing through the flow restrictor 89*a*, and accordingly the flow to atmosphere is increased at the expense of the recirculation flow in the air recirculation branch 69*b*.

In FIG. 15 the bypass branch 69*c* is shown as branching from the air recirculation line 69 upstream of the location where it splits into the branches 69*a* and 69*b*. However, the bypass branch 69*c* could alternatively branch out of the vent branch 69*a* upstream of the flow restrictor 89*a*. Similarly, the bypass branch 69*c* is shown in FIG. 15 as connecting with the vent branch 69*a* downstream of the flow restrictor 89*a*, but it would be possible for the bypass branch 69*c* to vent to atmosphere independently rather than reconnecting to the vent branch 69*a*.

Figure 16:
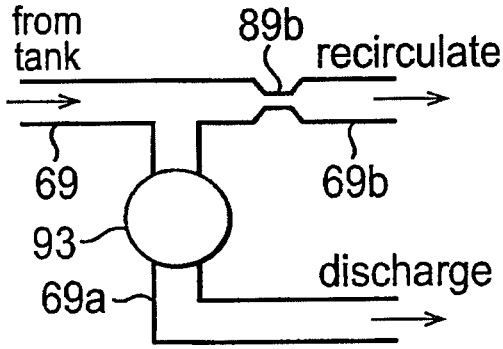

FIG. 16 shows an alternative arrangement to the air recirculation line branching arrangement of FIG. 15. In FIG. 16, the flow restrictor 89*a* in the vent branch 69*a* is replaced by a flow restriction valve 93. This can be moved between a position in which it significantly restricts flow in the vent branch 69*a*, to provide a similar effect to the flow restrictor 89*a*, to a position in which it allows a substantially less restricted flow, thereby permitting an increased proportion of the air in the air recirculation line 69 to be discharged to atmosphere. If the flow restriction valve 93 is continuously variable between its extreme positions, or has one or more intermediate positions between its most open position and its most flow-restricting position, a finer degree of control can be provided over the proportion of the air in the air recirculation line 69 that is discharged to atmosphere. This makes it possible to implement more sophisticated control regimes, such as discharging a high proportion of the air to atmosphere when the ink is highly overdilute, and discharging an intermediate amount of air to atmosphere when the ink is slightly overdilute, enabling a balance to be made between the environmental disadvantage of discharging solvent-laden air to atmosphere and the operational desire to strip excess solvent out of the ink.

Figure 17:
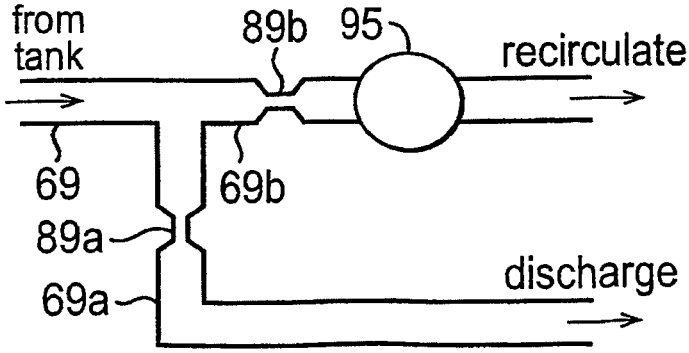

In the arrangements of FIGS. 15 and 16 the function of selectively increasing the proportion of the air discharged to atmosphere is provided by bypassing or reducing the flow restriction effect in the vent branch 69*a*. As shown in FIG. 17, it is possible as an alternative to increase the proportion of the air discharged to atmosphere by closing off or further restricting flow in the recirculation branch 69*b*. In FIG. 17 this is achieved by providing a shutoff valve 95 in the recirculation branch 69*b*. If this valve is closed, all of the air in the air recirculation line 69 will be discharged to atmosphere. Alternatively the valve may be almost closed, so as to provide an increased flow restriction in the recirculation branch 69*b*, so that an increased amount of air is discharged to atmosphere but some recirculation flow continues. In FIG. 17 the shutoff valve 95 is shown downstream of the flow restrictor 89*b*, but it may also be provided upstream of the flow restrictor 89*b*.

In a modification to FIG. 17 (not illustrated), the shutoff valve 95 and the recirculation branch flow restrictor 89*b* may be combined in a flow restriction valve similar to the flow restriction valve 93 discussed with reference to FIG. 16. This flow restriction valve could be moved between a position in which it shuts off the recirculation branch 69*b* entirely or provides a high degree of restriction, and a second position in which it provides a lower degree of restriction or none at all.

Figure 18:
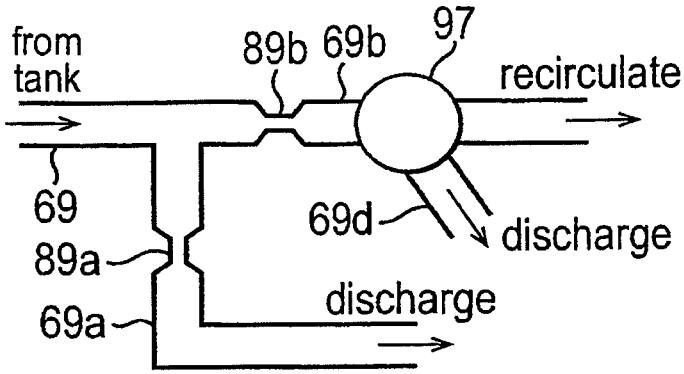

A further alternative arrangement is shown in FIG. 18 in which the shutoff valve 95 of FIG. 17 is replaced by a switchover valve or flow diverter 97. This allows the flow of air entering the recirculation branch 69*b* to be partially or wholly redirected into an additional discharge branch 69*d* in order to increase the proportion of air discharged to atmosphere. If a multi-position or continuously variable flow diverter is used, intermediate levels of air discharged to atmosphere can be obtained as well as the maximum and the minimum levels. In FIG. 18 the switchover valve or flow diverter 97 is shown downstream of the recirculation branch flow restrictor 89*b*, but it can instead be placed upstream of the flow restrictor. Additionally, FIG. 18 shows the additional discharge branch 69*d* as discharging directly to atmosphere. However, it can alternatively be arranged to connect with the vent branch 69*a* downstream of the vent branch flow restrictor 89*a*.

Figure 19:
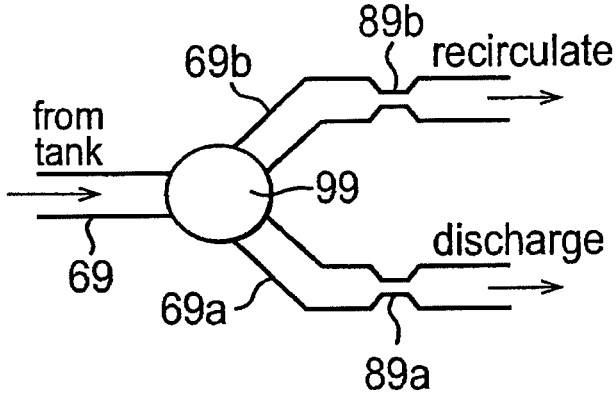

In FIG. 19 a flow diverter 99 is provided at the junction where the air recirculation line 69 branches into the vent branch 69*a* and the recirculation branch 69*b*. The flow diverter 99 can be operated to vary the proportion of the air passing along the air recirculation line 69 which is discharged to atmosphere through the vent branch 69*a*. In FIG. 19 the flow restrictors 89*a*, 89*b* are shown in the respective branches 69*a*, 69*b*. However, as an alternative these flow restrictors can be omitted and the flow diverter 99 can be made entirely responsible for controlling the relative proportions of recirculated air and discharged air.

Figure 20:
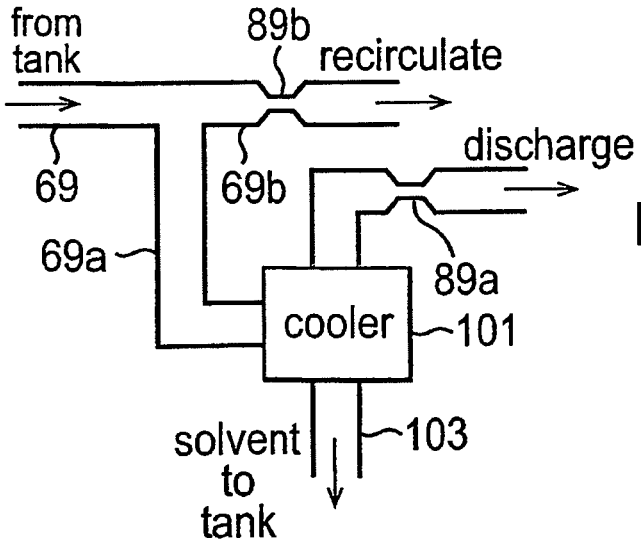

The amount of solvent which is discharged can be reduced by providing a solvent recovery device such as a cooler in the line which conveys the air being discharged to atmosphere. FIG. 20 shows a modification of the branching arrangement of FIG. 14 in which a cooler 101 is provided in the vent branch 69*a*, to condense solvent out of the air passing along the vent branch 69*a* and thereby reduce the amount of solvent discharged to atmosphere. The recovered solvent may be returned to the solvent tank 59 along a solvent return line 103. It may alternatively be returned to the ink tank 41, in which case the rate of loss of solvent from the ink is reduced. This may be disadvantageous if the ink is currently over-dilute, and therefore return to the solvent tank 59 is preferred.

The cooler 101 may be implemented in any convenient manner. For example it may be a Peltier cooler. Alternatively, it may be a cooler using compression and expansion of a refrigerant. As a further alternative, a coolant such as water, which has been cooled elsewhere, may be used to cool a pipe or vessel in the vent branch 69*a*.

If the air recirculation line 69 starts from the solvent tank 59, as shown in FIGS. 12 and 13, the air pressure inside the solvent tank 59 must be higher than the air pressure inside the cooler 101, in view of the flow of air along the air recirculation line 69. This pressure difference may tend to cause an undesirable flow of air from the solvent tank 59 into the cooler 101 along the solvent return line 103. Accordingly, it may be desirable to take steps to prevent this. For example, provided that the cooler 101 is situated higher than the solvent tank 59, the solvent return line 103 can open into the solvent tank 59 near the bottom of the tank rather than near the top of the tank, so that the open end of the solvent return line 103 is below the surface of the solvent in the tank 59. This means that any reverse flow in the solvent return line 103, caused by the greater pressure in the solvent tank 59, drives solvent up the solvent return line 103 rather than air. If this happens, the weight of solvent lifted up the line 103 acts to counterbalance the difference in pressure between the two ends of the line, stopping the reverse flow. As additional condensed solvent from the cooler 101 trickles down the solvent return line 103, its additional weight overcomes the pressure in the solvent tank and forces a corresponding amount of solvent out of the solvent return line 103 into the tank 59. In this way the correct flow direction in the solvent return line 103 is provided.

If there is any concern that the solvent recovered from the vent branch 69*a* is not suitable for re-use, for example because it is contaminated with condensed water, the solvent return line 103 may discharge into a separate solvent recovery tank, rather than the solvent tank 59 of the printer, allowing the recovered solvent to be processed in an environmentally suitable manner.

In FIG. 20 the cooler 101 has been shown upstream of the flow restrictor 89*a*, but it can be provided instead downstream of the flow restrictor. Additionally, the cooler 101 can be provided in the vent branch 69*a* of any of the alternative branching arrangements discussed with reference to FIGS. 15 to 19, and in the additional discharge branch 69*d* of FIG. 18.

Although FIG. 20 shows a cooler used as a solvent recovery device, any suitable alternative arrangement may be used. For example, it may be possible to condense solvent from the air by compression, or to remove solvent by absorbing it from the air with a suitable material.

It would also be possible to fit a cooler or other solvent recovery device in the air recirculation branch 69*b*, or in the air recirculation line 69 before it branches, with the result that some solvent has been recovered from the air which is returned to the printhead 25. This would have the consequence that the air entering the gutter flow path, that extends from the ink receiving orifice to the suction pump 51 or Venturi suction device 77, would be less saturated with solvent than would otherwise be the case, and would therefore strip additional solvent out of the ink passing along the gutter line 17.

In normal operation of the printer this would have no benefit, since the amount of solvent recovered from the air which is ultimately recycled back into the gutter flow path would substantially be matched by the increase in the amount of solvent lost from the ink in the gutter flow path. Furthermore, in view of possible contamination of the solvent during the solvent recovery process (e.g. contamination with water owing to excessive cooling), such an arrangement will tend to be disadvantageous. However, it can be used to replace or supplement any arrangement for temporarily increasing solvent loss by discharging extra air to atmosphere such as the arrangements described with reference to FIGS. 15 to 19, provided that the recovered solvent is not returned directly to the ink tank 41.

In all of FIGS. 15 to 19, the valves or flow diverters 91, 93, 95, 97, 99 may be under manual control by the operator, or alternatively if a motor or other operating mechanism is provided they may be controlled automatically by the ink jet printer control system in response to the ink viscosity as determined from the measured ink jet velocity and the ink pressure (or as determined in any other way, such as by a viscosimeter if one is fitted), or in accordance with any other suitable control procedure such as an arrangement which monitors whether a flushing operation has been performed recently, or the printer may be programmed to increase the proportion of air discharged to atmosphere automatically for a certain length of time whenever the printer is restarted after being turned off. It may also be controlled in accordance with changes in the level of suction applied to the gutter.

Figure 21:
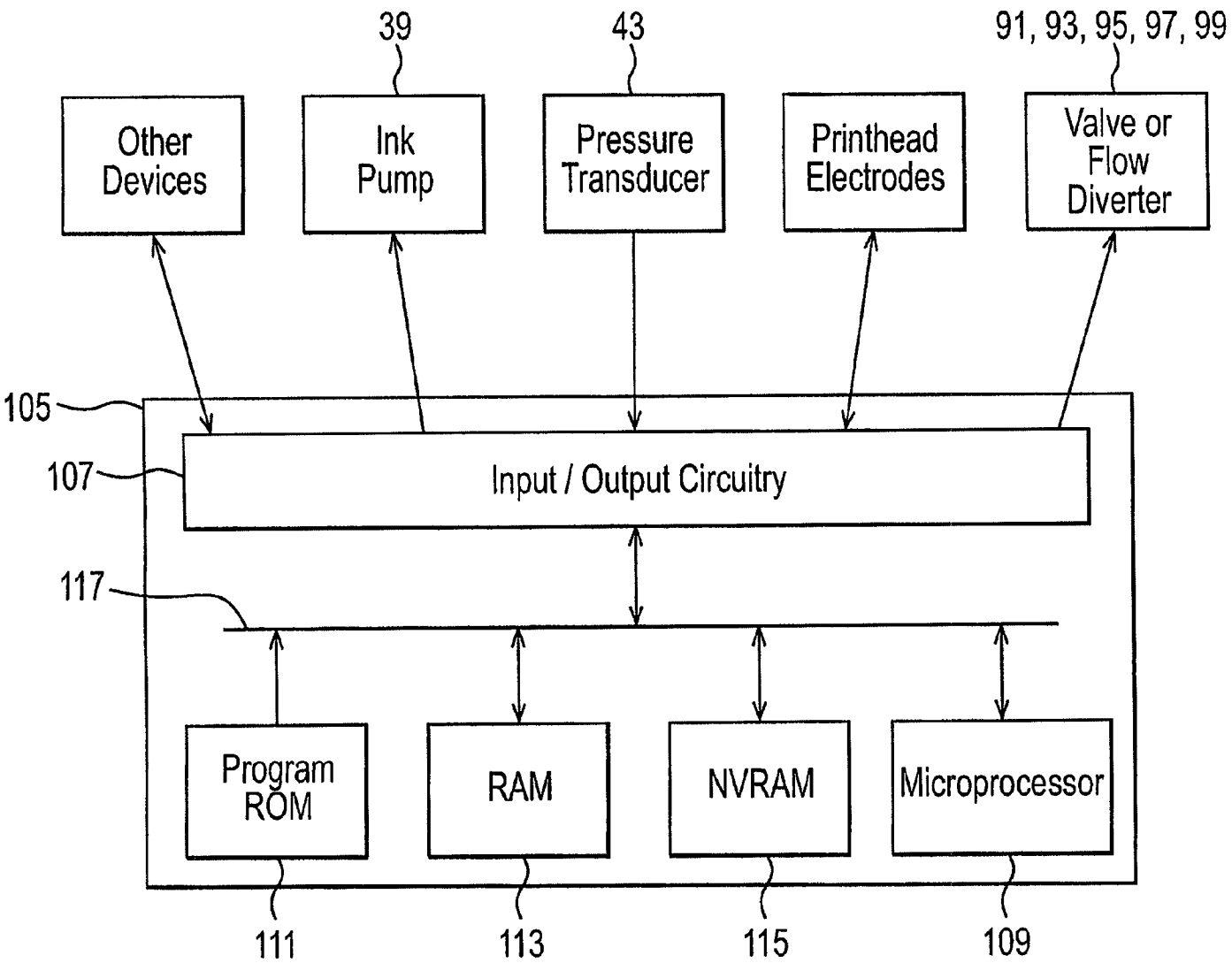
FIG. 21 is a schematic diagram of a control system for an ink jet printer embodying the present invention.

FIG. 21 shows schematically the arrangement of an ink jet printer control system which would be able to control the valve or flow diverter in this manner.

The control system 105 has input/output circuitry 107 through which it can send control signals to the valve or flow diverter 91, 93, 95, 97 or 99, send signals to and receive signals from the electrodes and other components in the printhead 25, receive ink pressure values from the pressure transducer 43, control the ink pump 39, and communicate with other components and devices such as the display 33, the keypad 35 and the various valves of the fluid system. The control system 105 further includes a microprocessor 109, a program ROM 111 storing a program for controlling the microprocessor 109, a random access memory 113 for providing a working memory for the microprocessor 109, and a non-volatile random access memory 115 for storing variable data which the printer needs to retain while it is turned off, such as setup and control information relating to its current configuration and the data to be printed, which may be entered by the operator through the keypad 35 or in any other convenient manner. These components of the control system 105 communicate with each other via a bus 117.

During operation of the printer the microprocessor 109 communicates via the input/output circuitry 107 with the printhead electrodes and other components so as to perform, amongst other tasks, a "time of flight" measurement operation in which ink drops are given a very slight charge, which still permits them to pass to the gutter, and the charged drops are detected as they pass two spaced apart sensor electrodes in the printhead. The time taken for the drops to pass from one sensor electrode to the other is measured to obtain the time of flight, which provides a measure of jet speed. Such operations are very well known to those skilled in the art.

The microprocessor 109 will monitor the pressure values received from the pressure transducer 43 continuously during normal operation of the printer, and these detected pressure values will be compared with a target pressure value stored in the RAM 113. The control signals sent to the ink pump 39 will speed the pump up or slow it down depending on the difference between the ink pressure values received from the pressure transducer 43 and the stored target value. From time to time the microprocessor 109 will compare the "time of flight" value obtained from the measurement operation described above with a target value stored in RAM 113 or NVRAM 115. The target pressure value used to control the ink pump 39 is adjusted if the measured time of flight differs from the target time of flight by more than a permitted margin. In this way, the microprocessor 109 keeps the ink jet velocity at or close to the target value.

A permitted range for the ink pressure is also stored in RAM 113 or NVRAM 115. If the target pressure set into the RAM 113, in order to maintain the correct time of flight, exceeds the top of the permitted pressure range, the microprocessor 109 controls the fluid system components such as the valves so as to perform an operation for transferring solvent from the solvent tank 59 into the ink, so as to dilute it. If the target pressure written into the RAM 113 falls below the minimum permitted value, this indicates that the ink contains too much solvent and the microprocessor sends signals to the valve or flow diverter 91, 93, 95, 97 or 99 to increase the amount of air vented to atmosphere in order to accelerate the rate at which solvent is lost from the ink. As discussed above, depending on the extent to which the valve or flow diverter is controllable, the microprocessor 109 may control its position in accordance with the extent to which the target ink pressure value falls below the permitted range.

As discussed above, the program stored in ROM 111, for controlling the microprocessor 109, may be arranged so that the microprocessor automatically controls the valve or flow diverter to increase the amount of air vented to atmosphere temporarily whenever the ink jet is restarted having been turned off. The printhead flushing operation discussed above is carried out under the control of the microprocessor 109 and the program may be arranged so that the microprocessor stores in NVRAM 115 the fact that such an operation has been carried out, and subsequently uses that information together with information about how long the jet has been running to evaluate the likelihood that the ink contains excessive solvent, and to control the valve or flow diverter accordingly. These various rules and arrangements by which the microprocessor 109 controls the valve or flow diverter 91, 93, 95, 97 or 99 may be used as alternatives to one another or may be used in conjunction, according to the wishes of the designer of the ink jet printer concerned.

Tests have been performed with an embodiment of the present invention, to demonstrate that solvent consumption is indeed reduced. Because the consumption of solvent varies between individual printers, and also varies depending on the way the printer is set up and used and the surrounding environmental conditions, it is not easy to obtain a precise figure for the amount of solvent saved. However, the following experiments were performed.

A Linx 6800 printer was fitted with a Linx Ultima printhead modified to provide recirculation back to the printhead of air which has passed down the gutter line and through the ink and solvent tanks. The recirculation was achieved by drilling an additional bore into the gutter block, to intercept the gutter bore, and the air recirculation line was connected to this additional bore, in accordance with the embodiment of FIGS. 1 and 2 and FIGS. 4 to 6. The printer was set up to run with Linx 3103 ink and 3501 solvent, which is a system based on a mixture of ethanol and acetone. The caps and associated filler tubes for the ink and solvent tanks were replaced with turned plugs to prevent any uncontrolled venting to atmosphere. The printer body, conduit, printhead and power cable were weighed with the printer ready to operate. Then the printer was set to operate with the jet running continuously but without printing, so that the jet was always directed into the gutter. The printer, conduit and printhead sat on weighing scales throughout the experiment so that their combined weight could be monitored. At the end of the test, after the printer had been shut down, the combination of printer body, conduit, printhead and the power cable was weighed again.

Initially, it proved to be difficult to obtain meaningful figures for solvent consumption with this setup. The experiments were initially conducted in a laboratory in which the temperature was uncontrolled, and it was concluded that the problems arose from the fact that small changes in temperature can have a large effect on the rate of evaporation of the acetone component in the solvent. Accordingly, the printer was converted to use Linx 1240 ink and Linx 1512 solvent (which is a system based on methylethylketone), and further experiments were conducted with the printer sitting in a controlled environmental chamber maintained at a constant 25° C. In the experimental regime, the printer was placed in the chamber and left unpowered overnight to achieve ambient temperature, and then a test was run the following day.

Additionally, the branch line venting some of the air to atmosphere was initially fitted with a very small flow restrictor (having an internal diameter of about 0.25 mm), and this resulted in the ink not being adequately sucked clear of the gutter, so that ink spilled out of the gutter orifice. Subsequent tests were conducted with matching flow restrictors, each having an internal diameter of 0.6 mm, in the vent branch line taking air to atmosphere and the recirculation branch line delivering recirculated air to the gutter block. In this printer, the gutter line had an internal diameter of 1.6 mm, the air recirculation line had an internal diameter of 3.0 mm, and the air recirculation path within the gutter block, where it opens into the gutter, had an internal diameter of 1.0 mm. With this arrangement, tests were conducted with the printer first running without modification (no recirculation of air and no flow restrictor in the line used to vent the air from the gutter line). This arrangement showed a solvent consumption of approximately 60 grams during a seven hour test.

Solvent consumption was then tested with the air recirculation system in place, and 0.6 mm flow restrictors as discussed above in both the line delivering recirculated air to the gutter block and the line venting air to atmosphere. This arrangement was tested twice. On the first occasion, approximately 29 grams of solvent were consumed during seven hours and on the second occasion approximately 27 grams of solvent were consumed in seven hours. Accordingly, these experiments indicated a reduction in solvent consumption to about 50% of the amount consumed when the printer was not modified.

As a further test, the printer was set up so that none of the air passing down the gutter line was recirculated back to the printhead, but the line venting the air to atmosphere was fitted with a flow restrictor in the same way as in the experiments conducted with air recirculation. In this case, there was a solvent consumption of approximately 56 grams during seven hours. This shows that using a flow restrictor to reduce the rate at which air flows in through the gutter orifice and along the gutter line has some effect on the rate of consumption of solvent, but most of the reduction in solvent consumption shown in the experiments appears to be attributable to the recirculation of air back to the gutter block.

It should be understood that the experiments discussed above relate to solvent consumption in one particular printer set up to use one particular ink and solvent arrangement and operating in a particular environment, and tests with different printers and under different conditions are likely to provide different results. For example, the level of gutter suction and the amount of solvent consumed are likely to be affected by factors such as (i) the relative height of the printhead and the printer main body and (ii) the length of the conduit and the bore of the tubes within it. However, these experiments appear to confirm the principle that the consumption of solvent can be reduced by feeding air already laden with solvent directly back into the gutter flow path.

The arrangements of FIGS. 15 to 19, in which the relative proportions of air being recirculated and air being vented may be varied, also embody a separate aspect of the present invention which is not limited to feeding the recirculated air directly back into the gutter flow path. These arrangements may also be used in embodiments in which the air recirculated to the printhead is discharged into the space containing the ink jet, as shown in FIGS. 22 to 25. The disclosure above with respect to FIGS. 1 to 21 also applies to the embodiments of FIGS. 22 to 25 with the exception that the recirculated air is delivered to a different place in the printhead from the embodiment of FIGS. 1 and 2, and that in the arrangements of FIGS. 16 and 19 the valve 93 or flow diverter 99 may be arranged to close off the vent branch 69*a* completely, since in the embodiments of FIGS. 22 to 25 it is possible to recirculate 100% of the air which passes down the gutter line 17.

Figure 22:
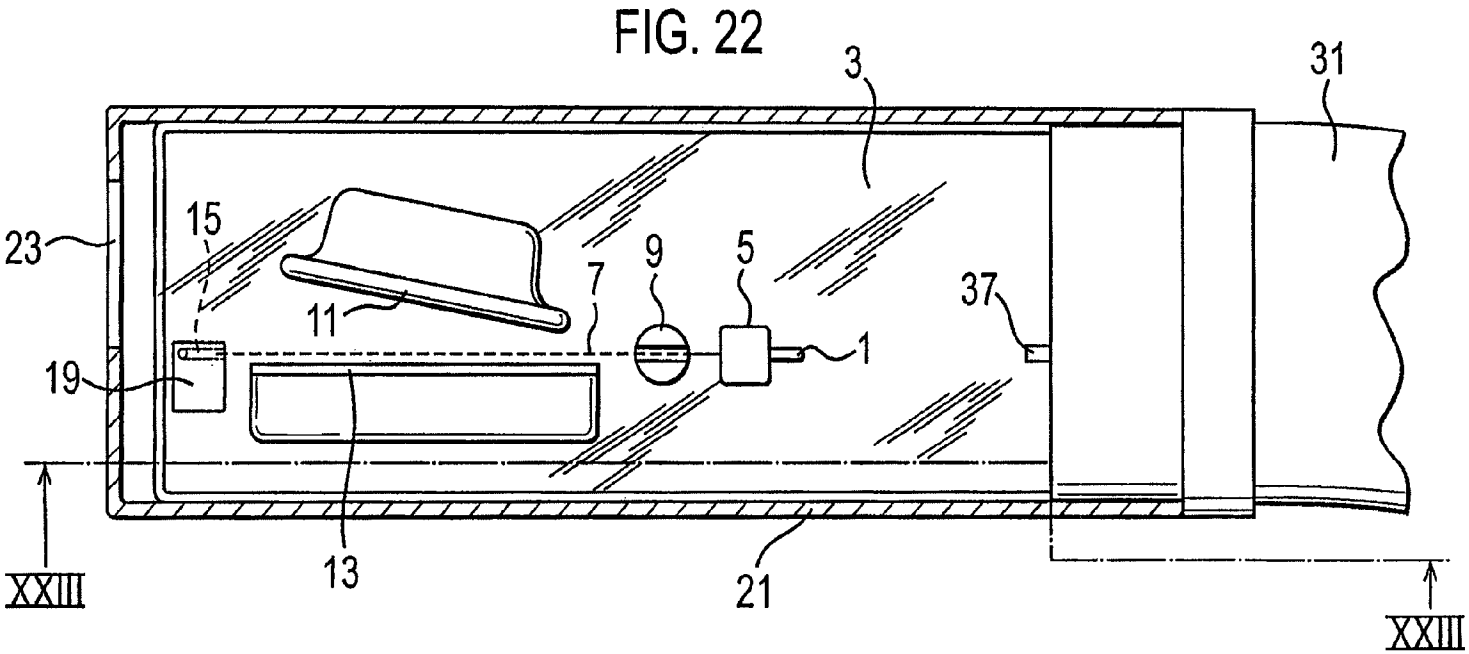
FIGS. 22 and 23 are plan and side views respectively, corresponding to FIGS. 1 and 2 respectively, of a second embodiment of printhead.
Figure 23:
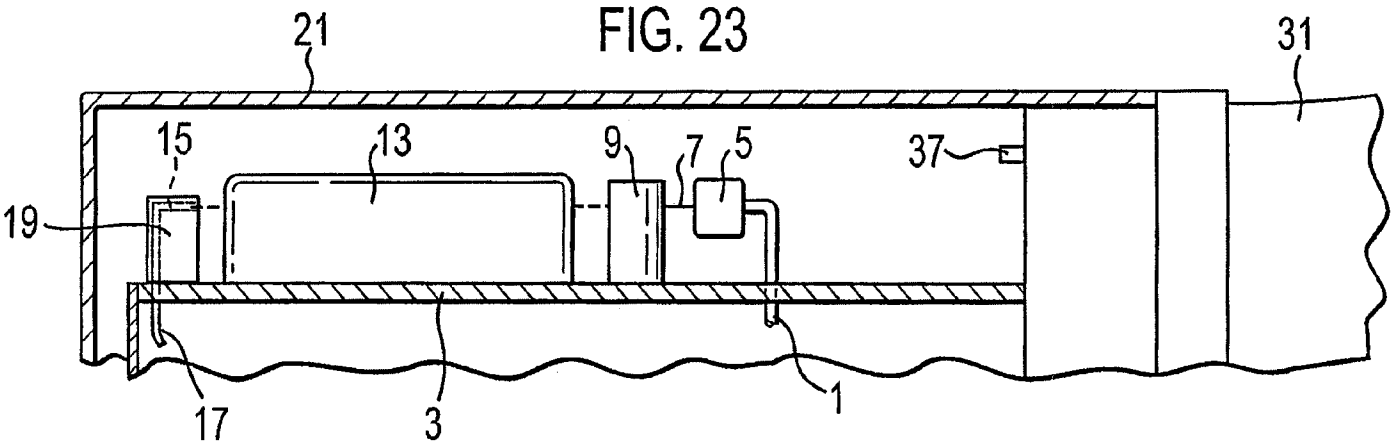

FIGS. 22 and 23 are plan and side views, corresponding to FIGS. 1 and 2 respectively, of a second embodiment of the printhead, in which air which has passed along the gutter line 17 and has been returned to the printhead 25 along air recirculation line 69 is not connected directly into the gutter block 19. In this embodiment, the pipe 37 receiving the recirculated air from the air recirculation line 69 opens into the space immediately above the other printhead components. This has the effect that the air drawn into the gutter 15 already carries some evaporated solvent. This reduces the ability of the air to absorb solvent from the ink as it passes along the gutter line 17, thereby reducing the loss of solvent from the system and the amount of solvent discharged to the environment. If 100% of the air from the gutter line 17 is recirculated back to the pipe 37, the amount of solvent-laden air escaping from the printer can be minimised and accordingly the rate of loss of solvent is minimised.

Figure 24:
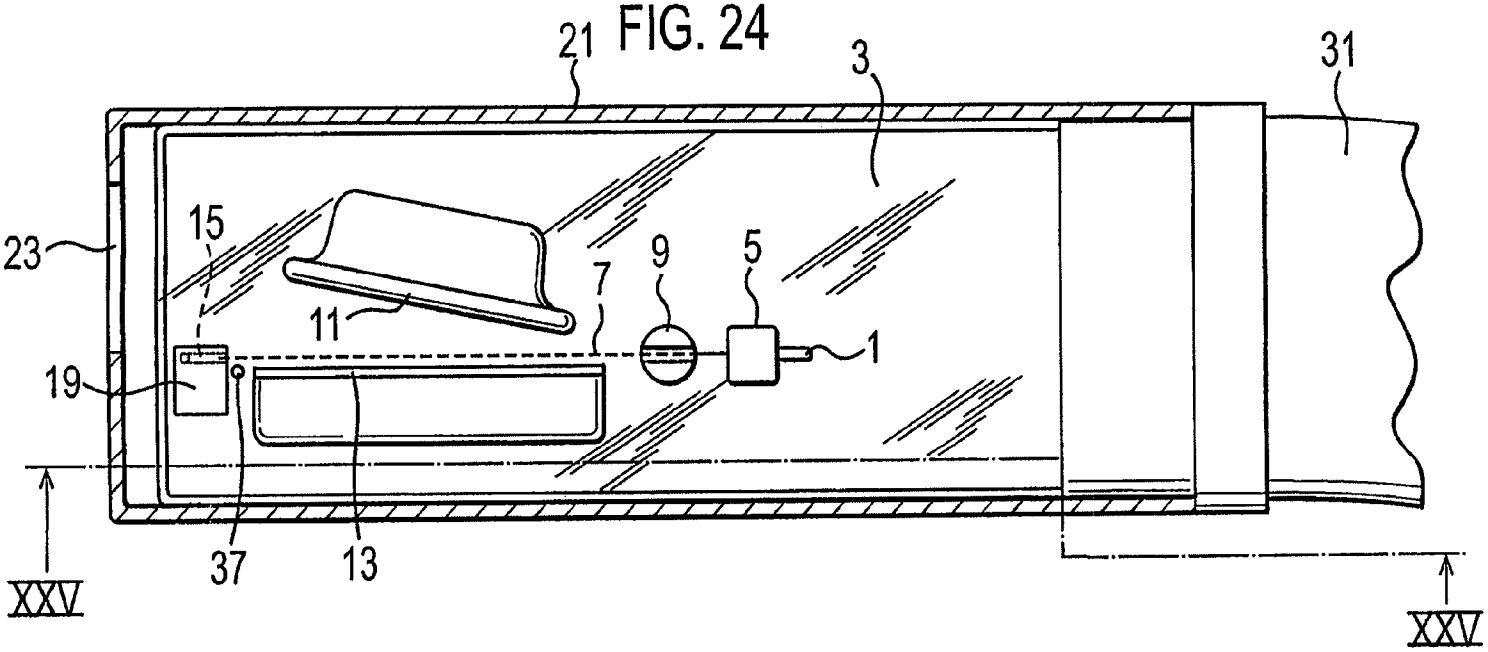
FIGS. 24 and 25 are plan and side views respectively, corresponding to FIGS. 1 and 2 respectively, of a third embodiment of printhead.
Figure 25:
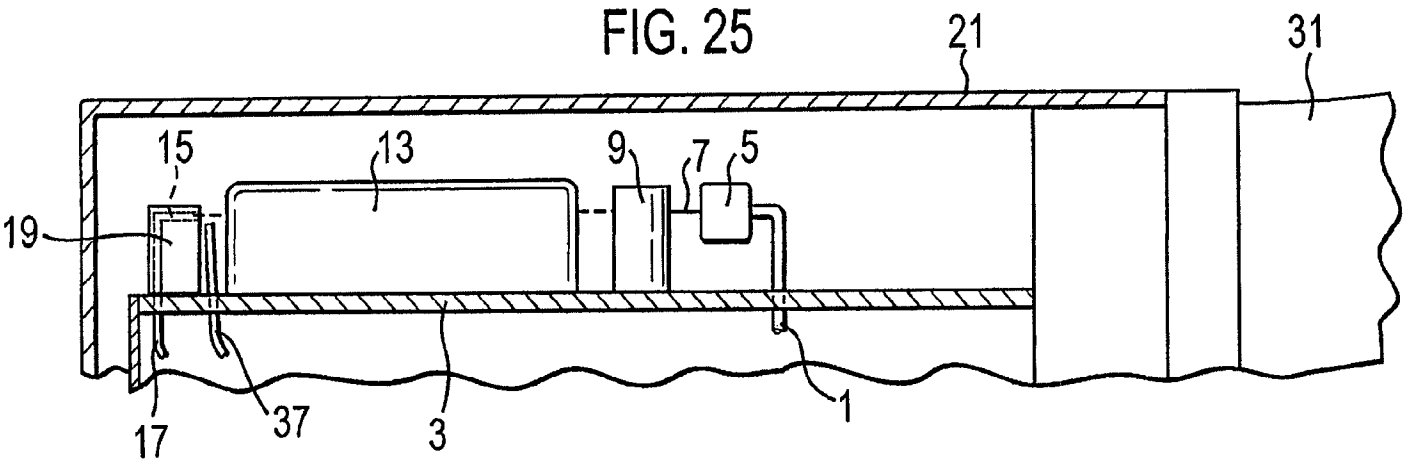

FIGS. 24 and 25 are plan and side views, corresponding to FIGS. 1 and 2 respectively, of a third embodiment of the printhead. In this embodiment, the pipe 37 has been repositioned to pass through the supporting substrate 3 and open close to the ink-receiving orifice of the gutter 15. The pipe 37 is positioned between the gutter block 19 and the deflection electrode 13 so as to be as close as possible to the gutter orifice while being positioned sideways from all paths which may be followed by the ink jet 7 in order to minimise disruption or deflection of the jet caused by movement of air out of the pipe 37.

This embodiment has several advantages over the embodiment of FIGS. 22 and 23.

In the embodiment of FIGS. 22 and 23 the space inside the printhead cover 21 will tend to fill up with solvent-laden air. This increases the load of solvent already carried by the air as it enters the gutter 15, but also results in a tendency for solvent to condense out on other components of the printhead. Bearing in mind that the ink is electrically conductive when wet, and there may be splashes of ink on the printhead components, this condensation can result in electrically conductive liquid on the components which may interfere with the correct operation of the various electrodes.

Finally, it is known to provide continuous ink jet printers with a "positive air" feature, in which a small supply of outside air is pumped into the volume enclosed by the printhead cover 21. Although the printhead cover 21 protects the jet 7 from the air in the vicinity of the printhead, if the printer is being operated in a very dusty or humid environment this "positive air" feature is used to ensure that there is a small outflow of air through the slot 23 in the cover 21, so as to prevent any outside air from entering through it. In this case, if the volume inside the cover 21 is full of solvent-laden air from the pipe 37, the air passing out through the slot 23 will be solvent-laden, increasing the solvent pollution to the printing location which may be undesirable in some cases.

By improving the coupling between the pipe 37 and the ink-receiving orifice of the gutter 15, the recirculation of solvent-laden air back into the gutter 15 can be obtained without the need for all of the air inside the printhead cover 21 to be saturated with solvent.

However, in any embodiment in which the recirculated air is vented into the space where the ink jet is formed, so as to re-enter the gutter line by being sucked in through the ink-receiving orifice of the gutter, it is preferable to take some additional steps to reduce the likelihood that solvent will condense on the printhead components, and in particular to avoid it condensing on the electrodes. For example, steps may be taken to ensure that the electrodes, and possibly other components, are at a higher temperature than the recirculated air (for example by cooling the recirculated air), or steps may be taken to condense solvent out of the recirculated air or remove solvent from it in some other way, so that the air entering the space where the ink jet is formed is not fully saturated with solvent.

The embodiments discussed above are provided by way of example and the present invention is not limited to these embodiments. Various modifications and alternatives will be apparent to those skilled in the art. For example, instead of providing a vent branch 69*a* from the air recirculation line 69, a separate vent line may be provided direct from the ink tank 41, the solvent tank 59 or any other convenient location downstream of the suction source 51, 77. In this case, the bypass and valve arrangements of FIGS. 15 and 16, and the solvent recovery system of FIG. 20, may be applied to the vent line, and the valve and diverter arrangements of FIGS. 17 and 18 may be applied to the recirculation line.

In an alternative that is particularly suitable if the suction source is not a Venturi in the pressurised ink line, the suction source may apply suction to the ink tank (which would not be separately vented). Suction is still applied to the gutter, but in this case the suction is applied via the air space in the ink tank. For example, in the fluid system of FIG. 12 the suction pump 51 could be moved to be in the line 67 or in the line 69 before it branches. If the suction pump is in the recirculation line 69, this line may be connected directly to the ink tank instead of to the solvent tank, as discussed above.

Additionally, the above embodiments show ink jet printer arrangements in which a printhead is connected to a printer body via a flexible conduit, since this is the most common arrangement in practice, but the invention is not limited to this. The ink gun, the electrodes 9, 11, 13, the gutter 15 and all the other printhead components may be in the same housing as the tanks and other fluid system components. In this case, the gutter line 17, the air recirculation line 69 and all the other lines which would normally pass along the conduit may be fluid connection lines that are contained wholly within the housing. Alternatively, the printhead may be fixed directly to the printer body without any conduit.

The invention claimed is:

1. A gutter for a continuous ink jet printer, the gutter having a first enclosed fluid flow path through it extending from a place for entry of ink from the ink jet of the printer in use to a place for connection to a suction line for sucking away ink in the first enclosed fluid flow path, and a second enclosed fluid flow path through it extending from a place for connection to a supply of air to a junction with the first enclosed fluid flow path, the junction being within the gutter and between the place for entry of ink and the place for connection to a suction line, and wherein the junction is no more than 10 mm along the first enclosed fluid flow path from the place for entry of ink.

2. The gutter according to claim 1, wherein the junction is no more than 5 mm along the first enclosed fluid flow path from the place for entry of ink.

3. The gutter according to claim 1, wherein the junction is no more than 2 mm along the first enclosed fluid flow path from the place for entry of ink.

4. A printhead for a continuous ink jet printer, comprising an ink gun for forming an ink jet and the gutter according to claim 1 for receiving ink drops of the ink jet that are not used for printing.

5. A method of operating a continuous ink jet printer comprising:

forming an ink jet;

trapping electric charges on ink drops of the ink jet and creating an electrostatic field for deflecting drops carrying trapped electric charges;

receiving ink drops of the ink jet, which drops are not used for printing, in a gutter via an ink-receiving orifice of the gutter;

conveying ink, that has entered the gutter through the ink-receiving orifice, along a gutter flow path;

recirculating some air that has passed along at least a part of the gutter flow path so that it re-enters the gutter flow path; and venting some air that has passed along at least a part of the gutter flow path so that it does not re-enter the gutter flow path.

6. The method according to claim 5, further comprising varying the relative proportions of the air that is recirculated and the air that is vented.

7. The method according to claim 5, wherein the air that is recirculated re-enters the gutter flow path downstream of the ink-receiving orifice.

* * * * *